US006164872A

United States Patent [19]

Morishige

[11] Patent Number: 6,164,872

[45] Date of Patent: Dec. 26, 2000

[54] METHOD OF PRODUCTION OF LARGE TANK, SYSTEM USING SUCH LARGE TANK AND SUBMERGED TUNNELING METHOD USING THE TANK

[75] Inventor: Haruo Morishige, Kobe, Japan

[73] Assignee: Mitsubishi Heavy Industries, Ltd., Tokyo, Japan

[21] Appl. No.: 09/068,445

[22] PCT Filed: Sep. 26, 1997

[86] PCT No.: PCT/JP97/03430

§ 371 Date: May 8, 1998

§ 102(e) Date: May 8, 1998

[87] PCT Pub. No.: WO98/13556

PCT Pub. Date: Apr. 2, 1998

[30] Foreign Application Priority Data

Sep. 27, 1996 [JP] Japan ..... 8-256461
Oct. 17, 1996 [JP] Japan ..... 8-274702

[51] Int. Cl.[7] ..... E02D 27/38

[52] U.S. Cl. ..... 405/210; 405/204

[58] Field of Search ..... 405/204, 203, 405/222, 205, 207, 208, 210

[56] References Cited

U.S. PATENT DOCUMENTS

| | | | |
|---|---|---|---|
| 873,581 | 12/1907 | McQueen | 405/222 |
| 1,758,606 | 5/1930 | Jacobs | 405/204 X |
| 2,748,739 | 6/1956 | Monti et al. | 405/210 X |
| 3,247,672 | 4/1966 | Johnson | 405/210 |
| 3,504,648 | 4/1970 | Kreidt . | |
| 3,537,268 | 11/1970 | Georgii | 405/204 X |
| 3,675,431 | 7/1972 | Jackson | 405/210 |
| 3,943,724 | 3/1976 | Banzoli et al. | 405/210 |
| 4,112,687 | 9/1978 | Dixon . | |
| 4,232,983 | 11/1980 | Cook et al. | 405/210 |

FOREIGN PATENT DOCUMENTS

| | | | |
|---|---|---|---|
| 48-17305 | 5/1973 | Japan . | |
| 53-34316 | 3/1978 | Japan . | |
| 0028626 | 2/1986 | Japan | 405/222 |
| 2-45387 | 2/1990 | Japan . | |
| 4-5475 | 1/1992 | Japan . | |
| 4-58001 | 2/1992 | Japan . | |
| Y2 5-12261 | 3/1993 | Japan . | |
| 0851094 | 10/1960 | United Kingdom . | |
| 2266347 | 10/1993 | United Kingdom . | |

OTHER PUBLICATIONS

Marine Engineer and Naval Architect, Dec. 1 19969 (1969–12–01), p. 525 XP002135559, "INSTANT 10,000 hp at 12,000 FT DEPTH"

*Primary Examiner*—Dennis L. Taylor

[57] ABSTRACT

The present invention relates to a method of manufacturing a tank which is too large to be built on the ground. In the method, a floating station (1012) is built on the sea, surrounding a first spherical shell section (1002*a*) which constitutes one end of the tank. In the floating station, a hollow cylindrical section is built in a vertical position, connected to the first spherical shell section. The second spherical shell section (1002*b*) constituting the other end of the tank is connected to the open end of the hollow cylindrical section.

1 Claim, 30 Drawing Sheets

FITTING OF OUTER SPHERICAL SHELL SECTION (WELDING)

DEPOSITION OF CONCRETE

TANK BASE

CONSTRUCTING OF A MOUND

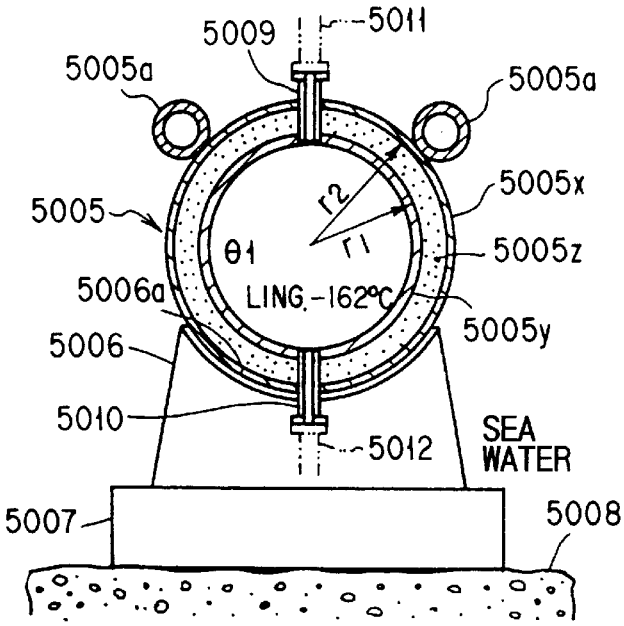
FIG. 35
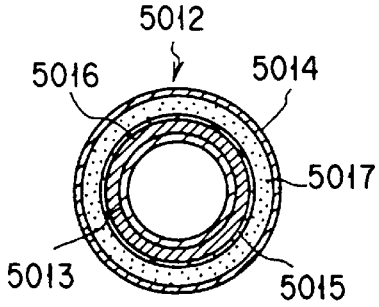
FIG. 36
PHYSICAL PROPERTIES OF LNG
| COMPOSITION OF LNG | EXAMPLE OF COMPO-SITION | ATMOSPHERIC PRESSURE 1013mbar | | | CRITICAL CONSTANT | | |
|---|---|---|---|---|---|---|---|
| | | BOILING POINT | LATENT HEAT OF EVAPO-RATION | DENS-ITY | TEM-PER-TURE | PRES-SURE | DENS-ITY |
| METHANE $CH_4$ | | -161.45 | 510 | 0.72 | -82.5 | 46.0 | 0.162 |
| ETHANE $C_2H_6$ | | -88.65 | 490 | 1.35 | 32.55 | 48.8 | 0.203 |
| PROPANE $C_3H_{10}$ | | -42.05 | 426 | 2.01 | 96.65 | 42.4 | 0.217 |
| BUTANE $C_4H_{10}$ | | -0.65 | 386 | 2.70 | 152.05 | 38.0 | 0.228 |
FIG. 37

METHOD OF PRODUCTION OF LARGE TANK, SYSTEM USING SUCH LARGE TANK AND SUBMERGED TUNNELING METHOD USING THE TANK

This application is the national phase under 35 U.S.C. §371 of prior PCT International Application No. PCT/JP97/03430 which has an International filing date of Sep. 26, 1997 which designated the United States of America, the entire contents of which are hereby incorporated by reference.

TECHNICAL FIELD

The present invention relates to a method of manufacturing a large tank for use as an oil tank or a $CO_2$ storage tank, for use in building a submerged tunnel, a submarine living quarter or a submarine station, or for use as a battery tank.

The invention also relates to a combined system for deep-sea power storage and carbon dioxide dissolution.

Further, the invention relates to a deep-sea power storage system for generating electric power by using sea water.

Still further, the present invention relates to a submarine power storage system which is installed in the deep sea and which stores electric power by utilizing the pressure of sea water.

Moreover, this invention relates to a submarine storage system designed to store, for example, LNG.

Furthermore, the present invention relates to a method of building a submerged tunnel for drive ways and railroads, which runs on the seabed.

BACKGROUND ART

Conventionally, a submarine tank is built on land, in a horizontal position in a dock large enough to hold the entire tank.

A system may be constructed by using as large a tank as possible, for example, a cylindrical tank having a diameter of 100 m and a length of 400 m. Building of such a large tank on land is subjected to various restrictions. Hence, tanks that can be built on land are limited in size.

More specifically, if a large tank is manufactured on the land, its size is limited by the size and proof strength of the dock, and also by the draft of the dock and the depth of the neighboring water passages.

An object of the invention is to provide a method which can manufacture a tank that is too large to be built on land.

Such a large tank finds use in, for example, thermal power plant. A thermal power plant is located near the seacoast in most cases. The carbon dioxide gas (carbon oxide gas) generated in the thermal power plant will result in environmental disruption such as air pollution. Attempts have been made to dissolve the gas in sea water and thereby discard the gas, by using various methods.

More precisely, (1) a method of dissolving the carbon dioxide gas generated in the thermal power plant, directly in sea water; (2) a method of solidifying the carbon dioxide gas into dry ice and sinking the dry ice onto the sea bottom: and (3) a method of liquefying the carbon dioxide gas aboard a ship and dissolving the gas in the sea water, over a sea zone 100 m wide.

With the method (1) it is difficult to dissolve the carbon dioxide gas sufficiently. Furthermore, there exists the danger that the carbon dioxide gas blows up over the sea surface.

The methods (2) and (3) may render the sea water strongly acid. This is because the liquefied or solidified carbon dioxide is dissolved in the sea water, inevitably increasing the carbon dioxide concentration in the sea water, making the sea water strongly acid.

Consequently, the methods (2) and (3) affect the deep-sea life. The methods (2) and (3) may also induce environmental changes because it lowers the temperature of sea water. Further, a great amount of energy is required to perform the methods (2) and (3), in which carbon dioxide is solidified into dry ice and liquefied, respectively.

The present invention has been made in view of the above. An object of the invention is to provide a combined system for deep-sea power storage and carbon dioxide dissolution, which can store power, causing no cavitation of a high-head pump turbine, and which can dissolve and discard carbon dioxide at low cost, not affecting marine ecology or causing environmental changes.

The conventional power system is disadvantageous in the following respect. Hitherto known is a pumped storage power system in which water is pumped up at night by using surplus electric power, and electricity is generated in the day when the power consumption is at its peak. However, geographical conditions for a pumped storage power system are restrictive, and the building cost of the system is increasing much. In view of this, it has become difficult to construct new pumped storage power plants.

Recently a deep-sea power storage system has been proposed as a low-cost power plant. This system has less restriction on its geographical conditions, and can be constructed at low cost. The system comprises a main body and a battery tank. The main body, which has a pump turbine, is installed in the deep sea, together with the battery tank. At night, the surplus power generated on land is used to turn the pump turbine, thereby discharging sea water from the battery tank, and power is stored by virtue of the energy obtained from the water head between the sea level and the sea water level in the battery tank.

In the day when the power consumption is at its peak, sea water is poured into the battery tank, thereby turning the pump turbine and generating electric power, and the power thus generated is supplied to the land.

Jpn. Pat. Appln. KOKAI Publication No. 04-01940 based on a patent application, for example, in which the present applicants are named as inventors, discloses a deep-sea power storage system. In this system, sea water is introduced into the pressure-resistive vessel laid in the deep sea (usually, on the seabed), rotating the water turbine. The water turbine drives the generator, which generates electric power. The power generated is supplied to the land. In the system, the surplus power available on the land is used to drive the water turbine, pumping the sea water from the pressure-resistant vessel, thereby to store the electric power.

Studies must be conducted for the foundation of such a deep-sea power storage system, which is strong enough to withstand earthquakes. This is because earthquakes may happen at the seabed on which the system is installed.

Measures should be established that must be taken to repair the various components of the system, such as the pump turbine, if troubles should develop in these components in the deep sea. Furthermore, measures should be established that must be taken in case cavitation takes place. Cavitation is likely to happen when a vacuum similar to water vapor develops in the space above the sea water level in the battery tank as the pump turbine discharges the sea water from the tank.

The present invention has been made in view of the above. An object of the invention is to provide a deep-sea power storage system which is greatly resistant to vibration, which can easily be repaired, and which can operate reliably.

A conventional submarine power storage system is installed, with the battery tank and electrical/mechanical component cases (containing power-generating equipment, power-storing equipment and the like) provided and secured within the pressure-resistant vessel.

Therefore, an additional pressure-resistant vessel must be used in order to increase the output of the system a little, if necessary to meet an increased demand for electric power. In fact, it would be extremely difficult to satisfy such a demand as described above.

In the case of a pumped storage power plant constructed in a mountainous region, which utilizes the head of a water storage dam, the amount of power it can store is determined by the capacity of the dam. With this plant it is difficult to store more electric power.

In view of this, the present invention has been made. An object of the invention is to provide a submarine power storage system that can have its storage capacity increased even after the commercial operation.

There is the trend of stockpiling LNG, just like petroleum. The annual domestic consumption of LNG is about 55,000,000 $m^3$ at present. If LNG were to be stored for 120 days of consumption, like petroleum, it should be stored in an amount of 18,000,000 $m^3$.

In order to store this amount of LNG, 90 LNG tanks are necessary, each cable of storing 200,000 $m^3$ at most. At present there is no land large enough to build so many tanks. From an economical point of view, too, it is difficult to build these tanks.

It would be dangerous, as is pointed out, that LNG tankers frequently navigate along a gulf coast where thermal power plants are densely constructed, because the LNG tankers may likely to collide with each other.

Hitherto, LNG has been stored in LNG tanks built on the ground or half-buried in the ground. The LNG tanks must be made of press-stressed concrete or high-density reinforced concrete to acquire a press stress and withstand the inner pressure. The use of either material complicates the structure of the LNG tanks. This renders it difficult, from an economical viewpoint, to build LNG tanks of this type.

More precisely, a press stress must be applied to the conventional LNG tanks to prevent a tensile stress from developing even if the inner pressure of the tanks rises. In order to apply a press stress to the tanks, reinforcing bars and tendons are embedded in concrete, extending vertically and horizontally. This inevitably makes the tanks complex in structure.

Moreover, LNG acquires a pressure nearly equal to the atmospheric pressure when it is used. It must therefore be maintained at −162° C. to assume a liquefied state at the atmospheric pressure. This is an absolute requirement that must be fulfilled to attain safety. This maintenance of temperature is a hindrance.

Namely, energy should be used to accomplish forced cooling in order to maintain the gas at −162° C. or less for a long time under the actually applied pressure equal to or less than the atmospheric pressure.

Furthermore, a pump immersed in the LNG contained in an LNG tank is operated, forcing LNG cooled to −162° C. out of the LNG tank and supplying the same. Once a trouble has developed in the pump immersed in LNG, the plant cannot help but be stopped. The pump is, as it were, a lifeline to the plant.

Geographical, economical, cooling and LNG-supplying conditions for an LNG storage system can hardly be satisfied. As a matter of fact, it has hitherto been considered to be difficult to reserve (store) LNG for so long a time as petroleum.

This present invention has been made in view of the above. An object of the invention is to provide a submarine LNG storage system which can be constructed near cities and which can store LNG in great quantities for a long period of time.

Today, tunnels are dug in the seabed, thereby constructing roads and railways, thus providing routes connecting locations on the land.

The technique using a shield machine is employed to build tunnels in the seabed. In the course of building a tunnel in the seabed, large-scale measures must be taken to stop dead water. Besides, it usually takes a long time of period to dig the tunnel in the seabed.

Recently, so-called submerged tunnel technique has come into practical use. This technique is to submerge tunnel units made of concrete in the sea and connect the units in series on the seabed, thereby building a submerged tunnel. With the submerged tunnel technique it is easy to stop dead water. Further, the technique can build a tunnel within a short period of time.

The submerged tunnel technique is carried out as follows. First, concrete tunnel blocks of the type shown in FIG. 45 are made on the ground, each having passages for roads or railways. Then, the tunnel blocks a towed by tugboats to an a building site on the sea, submerged there in the sea, anchored on the seabed and connected in series, thus building a submerged tunnel.

Very recently it has been proposed that big and long tunnel blocks, each having roadbeds and railway tracks, be used to build a submerged tunnel on the seabed. A large-scale transport route can thereby be provided.

It is difficult, however, to manufacture such gigantic tunnel blocks a on the ground, for some reasons. A large land is required, and transport equipment (hoisting system) must be provided. To make matters worse, the manufacturing efficiency is low since the manufacture site extends horizontally and is considerably spacious.

Furthermore, manufacturing tunnel blocks on the ground requires much cost and many man-hours. This is because concrete needs to be deposited in a great amount in order to form the horizontal sections of each tunnel block, and also because many reinforcing members must be laid before concrete is deposited to manufacture each tunnel block.

Also, additional reinforcing members must be used to prevent a tensile stress from developing in the concrete sections while the tunnel block is being made on the ground. More specifically, unless reinforcing bars are laid for preventing a tensile stress, after a block of steel plates has been made, concrete can not be deposited in the steel shell.

This means a reinforcing frame needs to be assembled twice. A considerably high cost and a number of man-hours are required only to deposit concrete.

Due to these facts, it is regarded as impossible to manufacture big and long tunnel blocks a on the ground. Further it is considered difficult to shorten the time of building a submerged tunnel. These hinder the construction of a large-scale submerged tunnel.

In view of this, the present invention has been made. Its object is to provide a technique of building a large-scale submerged tunnel within a short period of time, by using huge concrete tunnel blocks which can be manufactured at low cost.

DISCLOSURE OF INVENTION

According to a first aspect of the invention, there is provided a method of manufacturing a large tank, which comprises the steps of:

constructing a floating base on the sea, surrounding a first spherical shell section constituting one end of a tank;

building a hollow cylindrical section on the first spherical shell section, in the floating base; and attaching a second spherical shell section to the hollow cylindrical section, closing an open end thereof.

According to the invention, the vast space available on the sea and in the sea can be utilized in manufacturing the tank, because the large tank is pertly submerged in a vertical position while being manufactured. Restriction is not imposed, which would be inevitably imposed if the tank were built in a dock on the ground.

As a result, a large tank having a diameter of, for example, 100 m or more, can be manufactured.

The tank thus manufactured on the sea can be easily installed on the seabed in a horizontal position. Namely, it suffices to pour water into the tank, while pulling the tank by tugboats, thus inclining the tank into a horizontal position, then to tow the tank to the installation site, further to pour water into the tank, thereby submerging the tank in the horizontal position, and finally to mount the tank on the tank base already secured to the seabed.

If it is predicted that high waves come due to typhoon, the tank and the floats surrounding the tank may be submerged into the sea, by pouring water into their ballast tanks. Once in the sea, neither the tank nor the floats would be affected with winds or waves.

According to a second aspect of the invention, there is provided a combined system for deep-sea power storage and carbon dioxide dissolution, which comprises:

a tank which is installed on a seabed, into which sea water is poured, from which sea water is discharged, and which has a high-head section and a low-head section;

an electrical/mechanical component containing unit arranged on the seabed and adjacent to the tank, containing a low-head pump turbine into and from which sea water from the high-head and low-head sections of the tank flows, and a high-head pump turbine into and from which sea water flows from the high-head section of the tank and from a deep sea; and a carbon dioxide pipeline for supplying carbon dioxide from the ground into the sea water contained in the tank.

In the combined system for deep-sea power storage and carbon dioxide dissolution, sea water is supplied into the tank located in the deep sea, turning the high-head pump turbine and the low-head pump turbine provided in the electrical/mechanical component containing unit. Hence, the system can generate electric power.

Furthermore, sea water is discharged from the tank into the deep sea through the electrical/mechanical component containing unit. In the tank, the water from the high-head section into the inlet port of the high-head pump turbine, into which sea water flows from the deep sea. This prevents the carbon dioxide dissolved in the sea water from changing into gas, and thus preventing cavitation of the high-head turbine.

In addition, a great amount of carbon dioxide can be dissolved in the sea water contained in the tank by supplying carbon dioxide or liquefied carbon dioxide into the tank from the ground through the pipeline.

Thereafter, the sea water is discharged from the tank into the deep sea, whereby carbon dioxide is diluted. Hence, carbon dioxide can be discarded without raising the acidity of sea water around the combined system or lowering the temperature of the sea water.

The combined system for deep-sea power storage and carbon dioxide dissolution can store power in the deep sea, without causing cavitation of the pump turbines, and can dissolve and discard carbon dioxide at low cost, without raising the acidity of sea water or lowering the temperature of the sea water. The combined system would not affect marine ecology. Nor would it cause environmental changes.

According to a third aspect of the invention, there is provided a deep-sea power storage system which comprises:

a mound constructed on a seabed;

a system body having a battery tank and an electrical/mechanical component container containing at least a pump turbine and a generator/motor;

a unit base provided on the mound and supporting the system body; and a shock-absorbing member interposed between the mound and the unit base.

According to a fourth aspect of this invention, there is provided a deep-sea power storage system of the type described above. This system is characterized in that shock-absorbing member is made of hard rubber.

According to the third and fourth aspects of the invention, the vibration generated due to a submarine earthquake is not transmitted to the system body, thanks to the shock-absorbing member (hard rubber) interposed between the mound and the unit base which supports the system body.

According to a fifth aspect of the invention, there is provided a deep-sea power storage system of the type described above. This system is characterized in that the battery tank and electrical/mechanical component container is capable of floating on the sea.

According to the fifth aspect of the invention, the battery tank and the electrical/mechanical component container, which constitute the system body, can be floated to the sea level whenever necessary. This facilitates the repair and maintenance of the system body.

According to a sixth aspect of the present invention, there is provided a deep-sea power storage system of the type described above, which is characterized in that the battery tank is arranged with a lower surface located above the pump turbine contained in the electrical/mechanical component container.

In this system, the lower surface of the battery tank mounted on the unit base remains at a level above the pump turbine. A sufficient head is thus always secured at the inlet of the pump turbine, preventing cavitation of the pump turbine. This ensures a stable operation of the system.

According to a seventh aspect of the invention, there is provided a submarine power storage system which comprises:

a unit base connected by a submarine cable to a ground facility, having a plurality of container seats including spare seats, and equipped with electrical connecting pipes, connecting pipes and the like;

a plurality of electrical/mechanical component containers mounted respectively on the container seats excluding the spare seats, each of the containers containing a turbine, a generator a motor, a pump and the like; and a plurality of battery tanks connected by the connecting pipes to the electrical/mechanical component containers, respectively, and having a sea water inlet/outlet port each.

According to an eighth aspect of this invention, there is provide a submarine power storage system of the type described above, which is characterized in that each of the battery tanks has a connecting pipe detachably connected to the connecting pipe of a pipe coupling section provided on the unit base.

According to a ninth aspect of the invention, there is provided a submarine power storage system of the type described above. This system is characterized in that the unit base has a plurality of container seats including spare container seats and tank seats including spare tank seats. It is also characterized in that the battery tanks are mounted directly on the unit base, and in the unit base the battery tanks are connected to the turbines contained in the electrical/mechanical component containers.

According to a tenth aspect of the invention, there is provided a submarine LNG storage system comprising:

an LNG supply station provided on the ground or on the sea;

a large concrete storage tank installed on a seabed and connected to the LNG supply station by a gas pipeline and a liquid pipeline, for storing the LNG supplied from the LNG supply station through the gas pipeline and the liquid pipeline;

pump means for introducing a part of high-pressure gas generated in the LNG supply station, into an upper space in the storage tank through the gas pipeline, thereby to apply a pressure on the LNG contained in the storage tank and to pump the LNG upwards to the ground through the liquid pipeline; and cooling means for drawing gas from the upper space in the storage tank through the gas pipeline, thereby to cool the LNG stored in the storage tank.

Since the storage tank is installed on the seabed and stores LNG supplied from the LNG supply facility on the ground or on the sea. Nor particular location restrictions are imposed on the storage tank. In other words, the storage tank can be installed on the seabed near a city.

Once the tank is installed on the seabed, an external compressing force that depends on the depth where the tank is located is applied on the tank. The tank therefore assumes the same state as a pre-stressed tank. No tensile stress generates in the concrete section of the storage tank even if the inner pressure rises to the same value as the external pressure. The tank is simple in structure, not having a special pre-stressed structure. This solves an economical problem.

When the gas in the upper section of the tank is drawn through the gas pipeline, the LNG evaporates from the More specifically, the amount of LNG that should be evaporated from the surface of LNG, taking the latent heat of evaporation and, thus, cooling the liquid phase. The gas can be completely cooled to remain in liquid phase without using extra energy.

That is, a cooling system is constituted in the tank, which takes by itself the heat of evaporation from the surface of the LNG, thereby cooling the liquid phase of natural gas. The cooling condition required is thus satisfied. The cooling efficiency can, of course, be controlled by changing the flow rate of the gas.

A part of the high-pressure LNG gas generated in the LNG supply facility is supplied into the storage tank on the seabed through the gas pipeline. A pressure is thereby applied on the surface of the liquid in the tank, too. As a result, the LNG is pumped up to the ground through the liquid pipeline, which extends from the lower part of the tank.

Though not incorporating pumps, which are liable to malfunction, the tank has a pump system that pumps LNG autonomously. The conditions for pumping LNG are satisfied.

Controlling the amount of the gas can of course change the rate of pumping LNG. The LNG is thus pumped, because the tank is installed on the seabed and has a high pressure-resistance.

According to an eleventh aspect of the present invention, there is provided a method of building a submerged tunnel, which comprises the steps of:

manufacturing hollow cylindrical concrete tunnel blocks, each having both ends closed by spherical shell covers, while partly submerging the tunnel blocks in the sea in a vertical position such that a work platform remains at a predetermined level above the sea level;

submerging the tunnel blocks into the sea and arranging the tunnel blocks in series on a seabed;

connecting the tunnel blocks , while sealing circumferential walls of any two adjacent tunnel block from each other by means of a seal member;

draining water from a junction between any two adjacent tunnel blocks by discharging water from a closed space defined by the seal member and the opposing spherical shell covers of the tunnel blocks; and removing the covers, thereby making the tunnel blocks communicate with one another.

In this method, the tunnel blocks are assembled gradually on the sea, making good use of their buoyancy. A vast space available on the sea can therefore be utilized to manufacture tunnel blocks.

The method can built a large-scale submerged tunnel can, which has a driveway floor and a railway floor.

Furthermore, the site of manufacturing hollow cylindrical tunnel blocks is compact and small since the blocks are built, while being partly submerged in the sea in a standing position. This helps to enhance the manufacturing efficiency.

Partly submerged in the sea and set in a vertical position while being manufactured, the tunnel blocks excel in not only manufacturing cost but also in the number of man-hours required.

Namely, it suffices to deposit a small amount of concrete into the horizontal parts of each tunnel block, because the block is gradually submerged into the sea as it is manufactured. Further, reinforcing members which must be used to deposit concrete to build a tunnel block on the ground need not be employed at all, because the concrete section of the block, submerged in the sea, receives a compressing stress from the sea water.

Furthermore, the tunnel blocks not only excel in pressure-resistance and outer appearance, but also are simple in structure, not using reinforcing bars. This is because the blocks remain compressed while being manufactured. They may have, for example, steel-concrete structure, each composed of only steel plates and high-strength concrete.

Hence, it can be expected that a large-scale submerged tunnel be built at low cost and within a short time, though the tunnel blocks are long and huge ones. Moreover, the construction of the tunnel can be started at any point in the planned route or at two or at more points at the same time, because the tunnel blocks can be manufactured simultaneously on the sea. This helps shorten the time required for building the submerged tunnel.

BRIEF DESCRIPTION OF DRAWINGS

FIG. 35 is a sectional side view illustrating the storage tank;

FIG. 36 is a cross-sectional view of the liquid-supplying pipeline extending from the lower part of the storage tank;

FIG. 37 is a table showing the physical properties of LNG;

BEST MODE OF CARRYING OUT THE INVENTION

Embodiment 1

A method of building a large tank, which is an embodiment of the invention, will be described with reference to FIGS. 1 to 13.

This embodiment is a method of building a large cylindrical tank on the seabed, in a horizontal position.

Figure 12:
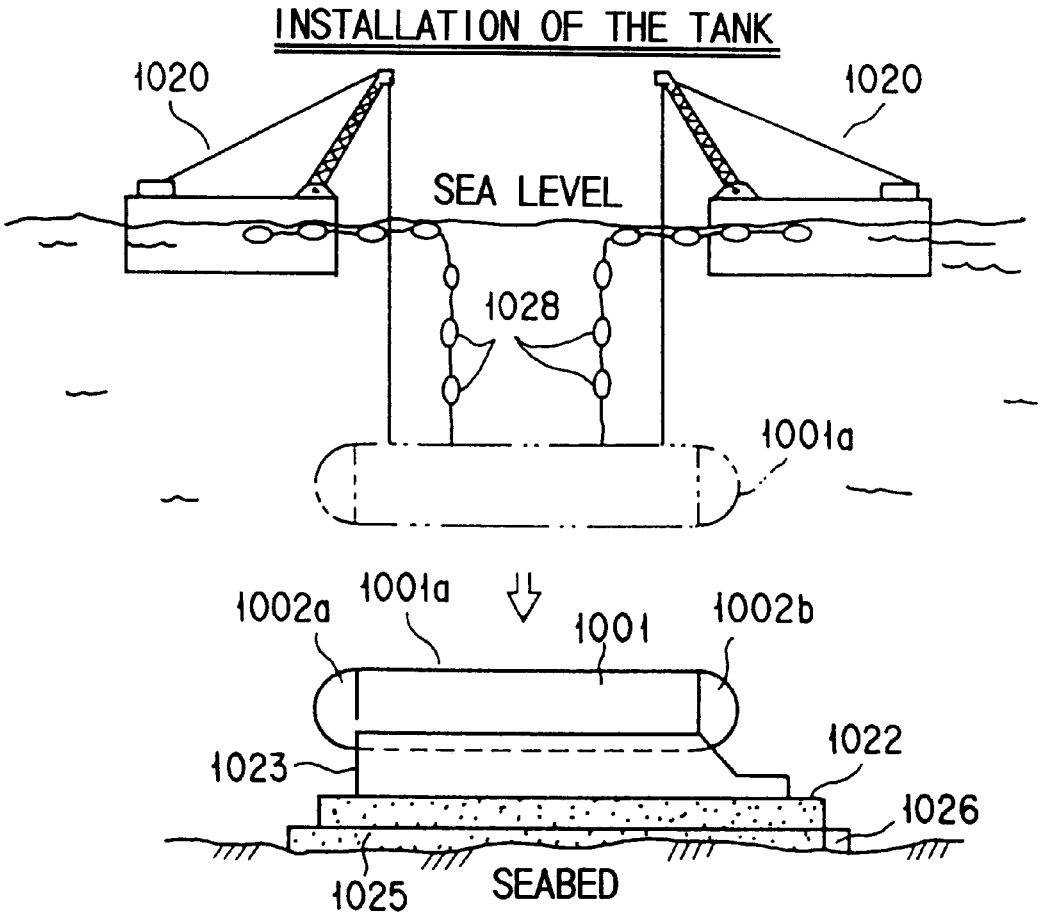
FIG. 12 is a diagram for explaining the step of holding the tank towed to the installation site, on the tank base secured to the mound.
Figure 13:
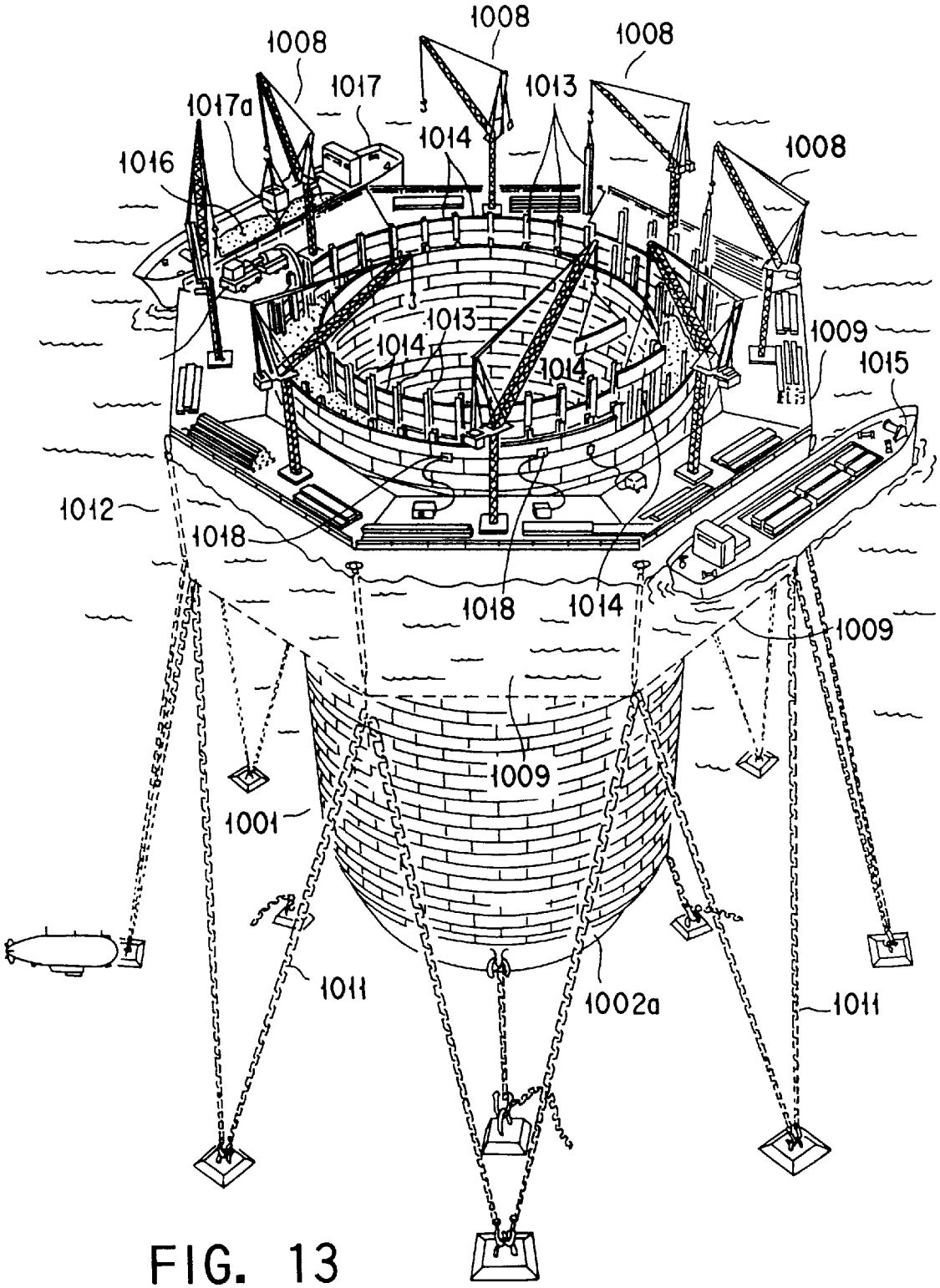
FIG. 13 is a perspective view depicting the step of building the cylindrical section at a floating station.

As shown in FIGS. 12 and 13, the large tank 1001*a* is a horizontal cylindrical tank. It comprises a cylindrical section 1001 and spherical shell sections 1002*a* and 1002*b* connected to the ends of the cylindrical section 1001. The cylindrical section 1001 is a cylindrical double wall made of, for example, steel plates 1014. The space in the double wall is filled with concrete. Each of the spherical shell sections 1002*a* and 1002*b* is made of a double wall composed of, for example, steel plates. The space in the double wall constituting either spherical shell section is filled with concrete.

Figure 1:
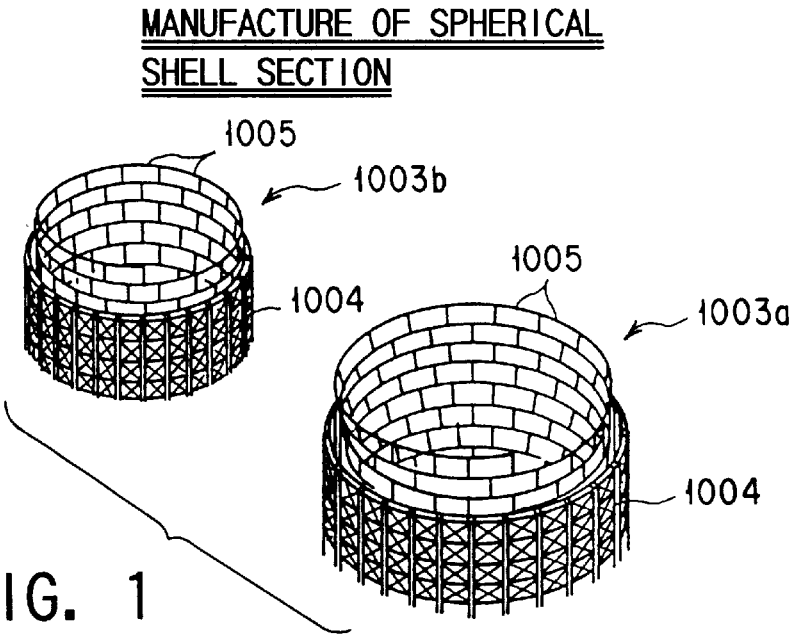
FIG. 1 is a perspective view explaining the step of building the outer and inner walls of the spherical shell section of a tank which is a first embodiment of the invention.

To build the large tank 1001*a*, both spherical shell sections 1002*a* and 1002*b* are assembled on the land, for example in a factory as is illustrated in FIG. 1. More correctly, an outer block 1003*a* (outer spherical section shaped like a dome) and an inner block 1003*b* (inner spherical section shaped like a dome) 1003*b*, which will constitute one spherical shell section (1002*a* or 1002*b*), are assembled on the land.

That is, pedestals 1004 are built on the ground. On the pedestals 1004, a number of arching steel plates 1005 are welded together, thus assembling an outer block 1003*a* and an inner block 1003*b*.

Figure 2:
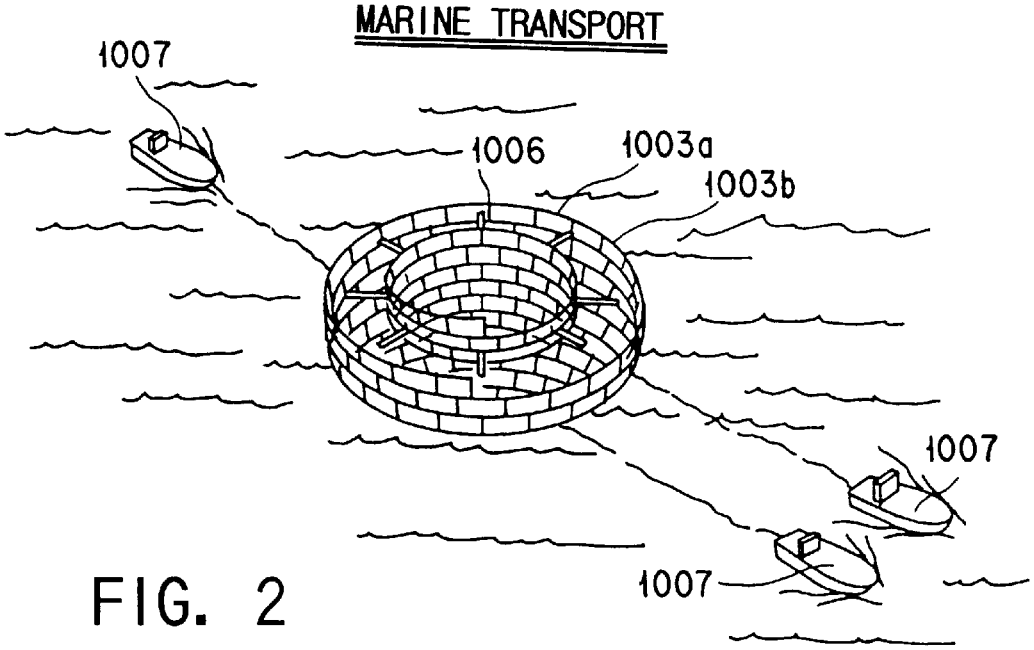
FIG. 2 is a perspective view explaining how the outer and inner walls of the spherical shell section are towed from the land to an assembly site on the sea.

Next, as shown in FIG. 2, the inner block 1003*a* is placed in the outer block 1003*b*, with an annular gap provided between these blocks 1003*a* and 1003*b*. A substantially semi-spherical (dome-shaped) assembly 1006 is thereby manufactured. The assembly 1006 is made to float on the sea and is then towed to an assembly site A on the sea, where a large tank will be built. To be more specific, several tugboats 1007 tow the assembly 1006 to the assembly site A on the sea.

The assembly site A is a position where the sea is relatively deep and the large tank 1001*a*, for example, can be built.

Figure 3:
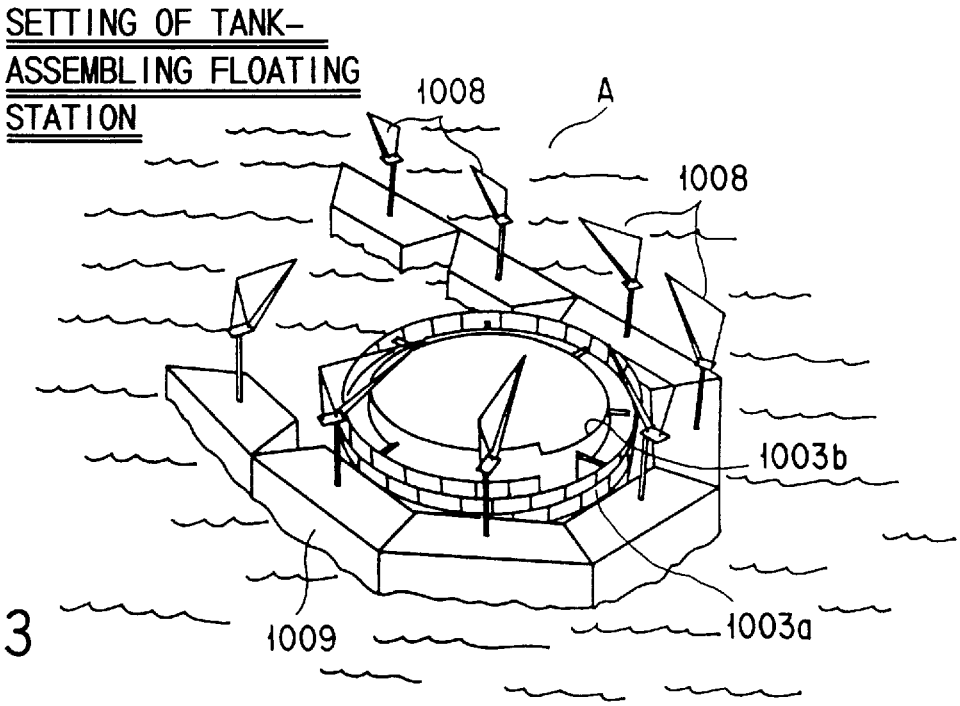
FIG. 3 is a perspective view depicting the step of building a floating station around the spherical shell section.

As shown in FIG. 3, a plurality of rectangular floats 1009, each with a crane mounted on it, are connected to one another, forming a ring surrounding the assembly 1006. The assembly 1006 and the floats 1009 are anchored to the seabed by means of anchoring members 1011 (as is illustrated in FIGS. 4 and 13).

A ring-shaped floating station 1012 is thereby constructed, around the assembly 1006.

Figure 4:
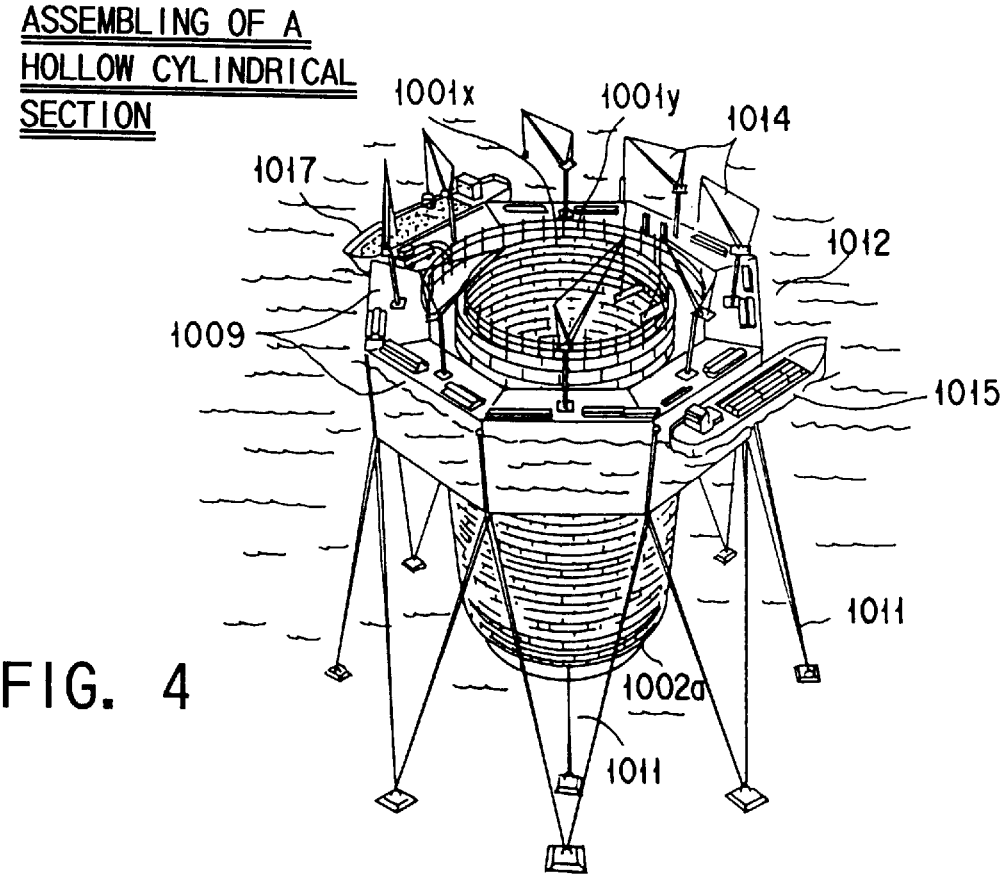
FIG. 4 is a perspective view illustrating the step of building a cylindrical section around the spherical shell section.

Then, as sown in FIGS. 4 and 13, a concrete butcher boat 1017, laden with concrete aggregate 1016, are moored at the floats 09. A pump turbine is driven, thereby depositing concrete into the gap between the inner block 1003*a* and the outer block 1003*b*.

One of the spherical shell sections of the large tank 1001*a*, i.e., the spherical shell section 1002*a*, is thereby formed.

Next, a hollow cylindrical section 1001 is built at the upper opening of the spherical shell section 1002*a*. The hollow cylindrical section 1001 gradually extends in a vertical direction.

More precisely, a transport boat 1015 is moored at one of the floats 1009, as is illustrated in FIG. 13. The transport boat 1015 is laden with various materials, including reinforcing members (e.g., H bars and the like) and steel sheets 1014 for constructing cylindrical walls.

The cranes on the floats 1009 hoist the reinforcing members 1013 and the steel plates 1014 from the boat 1015. These reinforcing members 1013 and steel sheets 1015 are used to form a cylindrical outer wall 1001*x* and a cylindrical inner wall 1001*y*, in the openings of the outer block 1003*a* and inner block 1003*b*, respectively. Both walls 1001*x* and 1001*y* gradually extend in the vertical direction.

That is, the reinforcing members 1013 hoisted are combined together, forming columnar frames extending upward from the inner surfaces of the blocks 1003*a* and 1003*b*.

The steel plates 1014 hoisted are welded onto the inner surfaces of the columnar frames made of the reinforcing members 1013. For example, the steel plates 1014 are laid on the upper edges of the steel plates constituting the outer block 1002*a* and inner block 1003*b*.

Welding machines 1018, for example, are used to fix together the steel plates 1014 and the reinforcing members 1013, thereby constructing the outer wall 1001*x* and inner wall 1001*y* of the cylindrical section 1001. The walls 1001*x* and 1001*y* have a prescribed height.

Thereafter, concrete scooped from the concrete batcher boat 1017 is deposited from a hopper 1017*a* into the gap between the walls 1001*x* and 1001*y* that form a double wall. Alternatively, concrete is pumped from the boat 1017 into that gap by means of the pump turbine 1019 mounted on the float 1009.

The reinforcing members 1013 are arranged vertically. Then, the steel plates 1014 are welded to the members 1013, forming the outer wall 1001*x* and the inner wall 1001*y*. Finally, concrete is deposited into the gap between the walls 1001*x* and 1001*y*. This sequence of work is repeated, whereby the cylindrical section gradually is gradually built, extending in the vertical direction (that is, upwards).

While the cylindrical section 1001 is being built, the buoyancy of the section 1001 is controlled. The tank as a whole is thereby moved such that the spherical shell section 1002*a* sinks into the sea. The open end of the cylindrical section 1001 at the same level as the floating station 1012.

More precisely, when the cylindrical section 1001 grows a particular height, fluid such as water is poured into the tank. The buoyancy of the structure is thereby controlled, setting the top of the cylindrical section 1001 at a level appropriate for facilitating the building of the cylindrical section 1001.

This operation is repeatedly performed until the cylindrical section 1001 comes to have a desired outer diameter and a desired length.

Next, another outer block 1003*a* and another inner block 1003*b*, both manufactured on the land, are fastened to the end of the cylindrical section 1001 thus completed.

Figure 5:
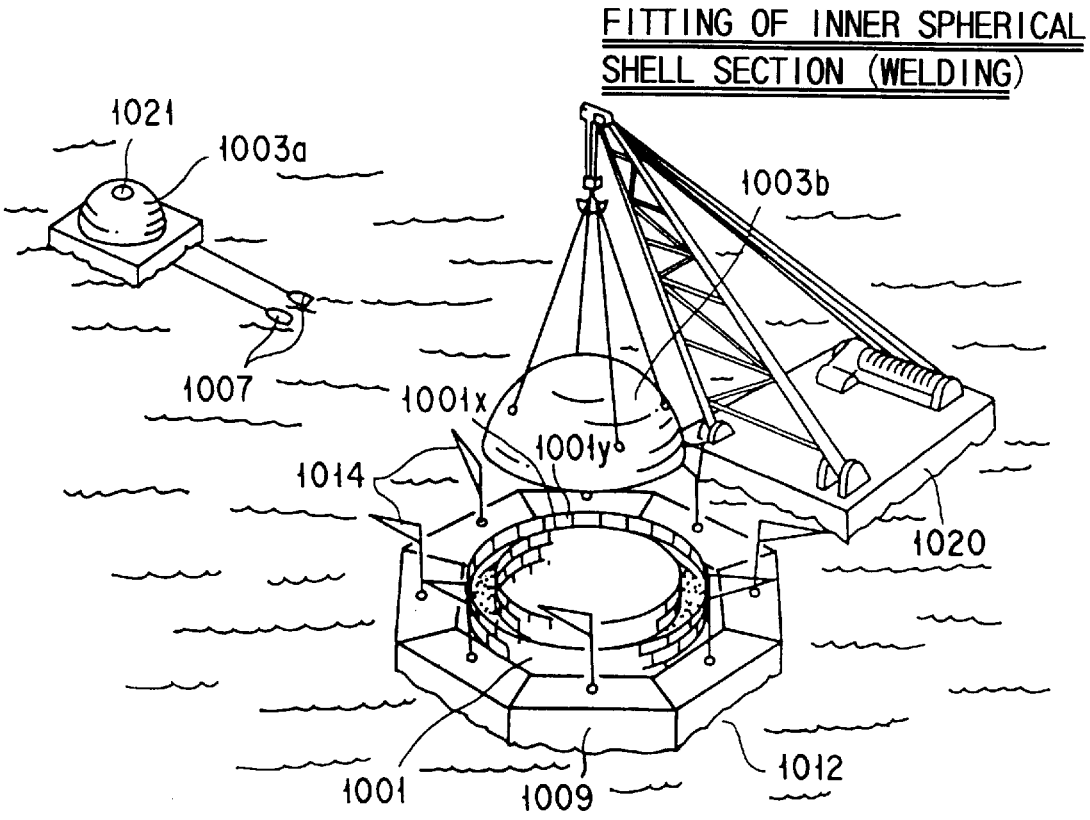
FIG. 5 is a perspective view explaining the step of fastening the inner wall of the spherical shell section to an end of the cylindrical section.

That is, as shown in FIG. 5, tugboats 1007 tow the substantially semi-spherical inner block 1003*b* manufactured in the factory on the land, to the floating station 1012. The inner block 1003*b* is hoisted and mounted onto the upper end of the hollow cylindrical section 1001, by means of a floating crane 1020. This done, the open end of the inner block 1003*b* is welded to the upper edges of the steel plates constituting the inner wall 1001*x* of the hollow cylindrical section 1001.

The inner block 1003*b* is thus installed.

Figure 6:
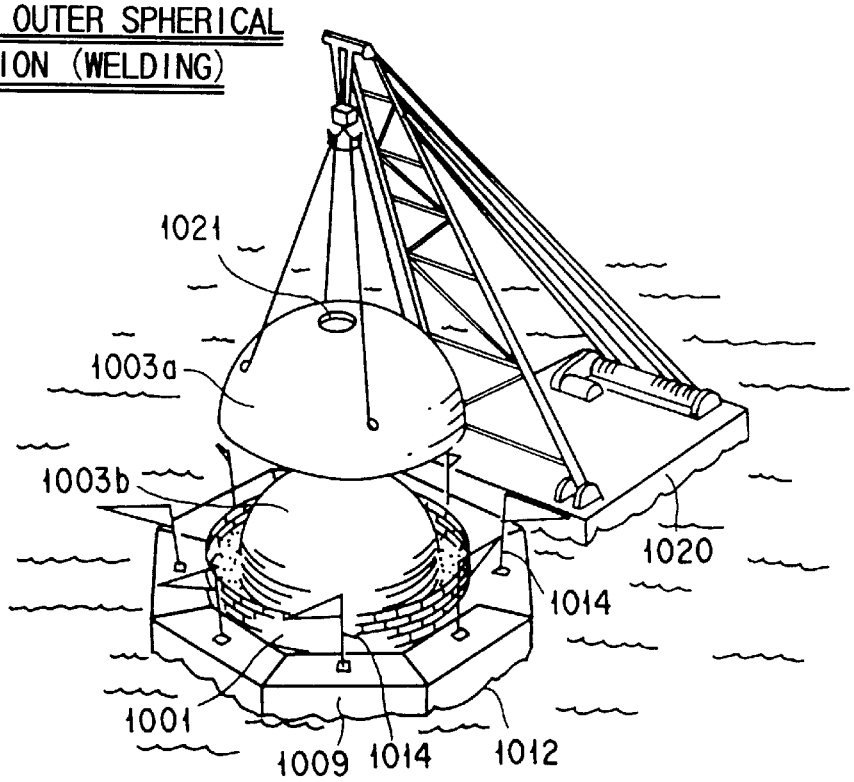
FIG. 6 is a perspective view depicting the step of fastening the outer wall of the spherical shell section to the end of the cylindrical section.

Thereafter, the semi-spherical outer block 1003*a* is towed from the land to the floating station 1010 as shown in FIG. 6, in the same way as the inner block 1003*b* has been towed. The outer block 1003*a* is hoisted and mounted onto the upper end of the cylindrical section 1001, by means of the floating crane 1020. The open end of the outer block 1003*a* is then welded to the upper edges of the steel plates constituting the outer wall 1001*y* of the cylindrical section 1001. The outer block 1003*a* is thereby installed.

Figure 7:
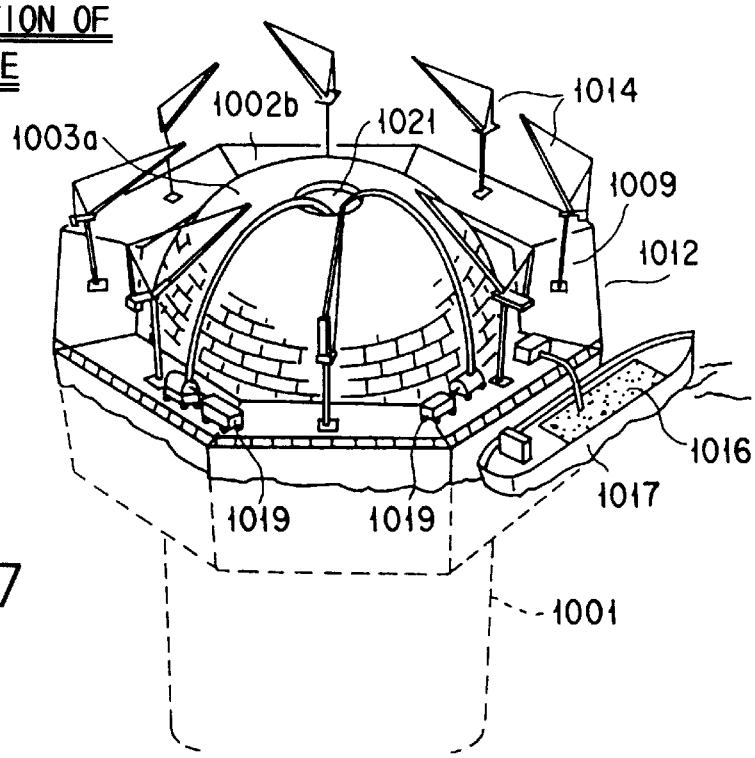
FIG. 7 is a perspective view explaining the step of depositing concrete in the gap between the outer and inner walls of the spherical shell section.

After both blocks have been installed, concrete is deposited into the gap between the outer block 1003*a* and the inner block 1003*b* as shown in FIG. 7, through an opening 1021 made in the outer block 1003*a*, from the batcher boat 1017. Alternatively, concrete is pumped from the boat 1017 into said gap through the opening 1021 by means of the pump turbines 1019 mounted on the floats 1009.

As a result, the other spherical shell section 1002*b* is made. The large tank 1001*a* is thereby built in its entirety.

As described above, the tank is built at sea by connecting steel plates, thus forming a double wall, and by depositing concrete into the space in the double wall. Needless to say, the invention can be applied to a tank using a wall structure of any other type which can withstand a pressure.

The large tank 1001*a* thus built may be laid on the seabed in a horizontal position. If so, the tank 1001*a* will be used as a horizontal submerged tank.

More specifically, as illustrated in FIG. 12, a foundation 1025 is built at the seabed, a mound 1022 is formed on the foundation 1025, and a tank base 1023 is secured to the top of the mound 1022. The tank base 1023 is as big as the large tank 1001*a*. The large tank 1001*a* is mounted and secured to the tank base 1023.

Figure 11:
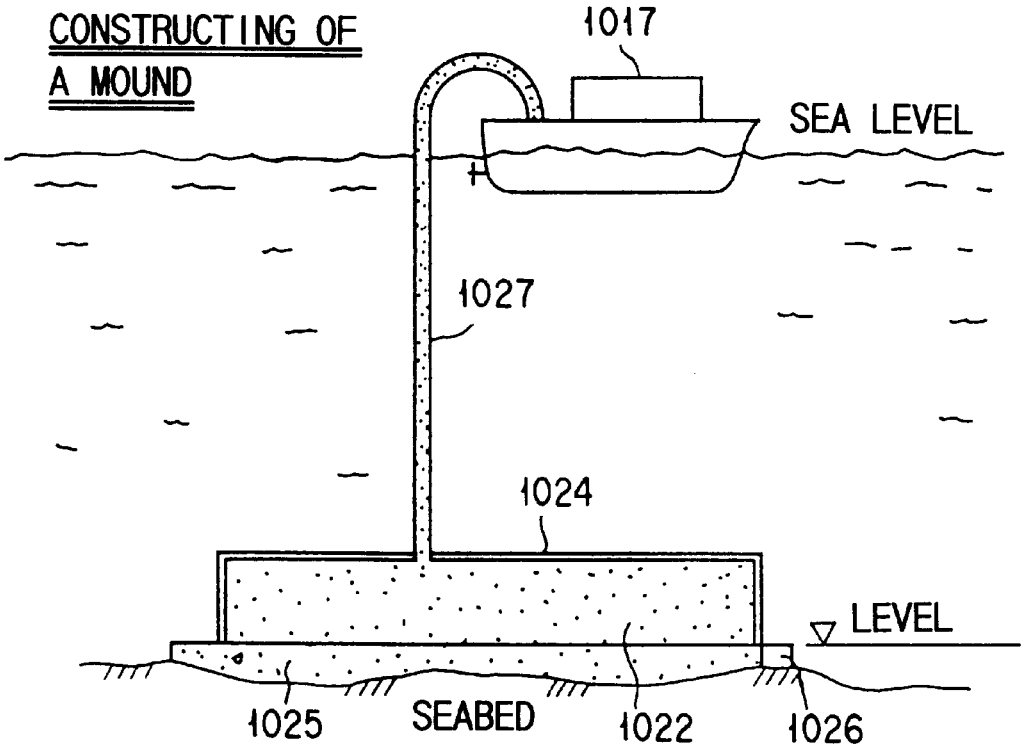
FIG. 11 is a perspective view explaining how a mound is built on the seabed, for holding the tank base.

As FIG. 11 shows, the mound 1022 is built as follows. First, a box-shaped base casing 1024 made of steel plates (made of steel) is lowered onto the foundation 1025 constructed on the seabed. Then, the casing 1024 is laid in a horizontal position at a prescribed level by using bases 1026. Finally, concrete is injected (under pressure) into the base casing 1024 from the concrete batcher boat 1017 through a chuter 1027.

The tank base 1023 has been manufactured in a factory on the land, for example in a factory, by using, for example, steel plates. As seen from FIG. 10, the tank base 1023 is shaped like an elongated box and has a recess 1023*a* in the top, in which the large tank 1001*a* can be fitted.

The tank base 1023 is transported to a site on the sea. At the site, the base 1023 is lowered into the sea and laid on the mound 1022 in a horizontal position.

Then, it suffices to install the large tank 1001*a* on the tank base 1023.

Figure 8:
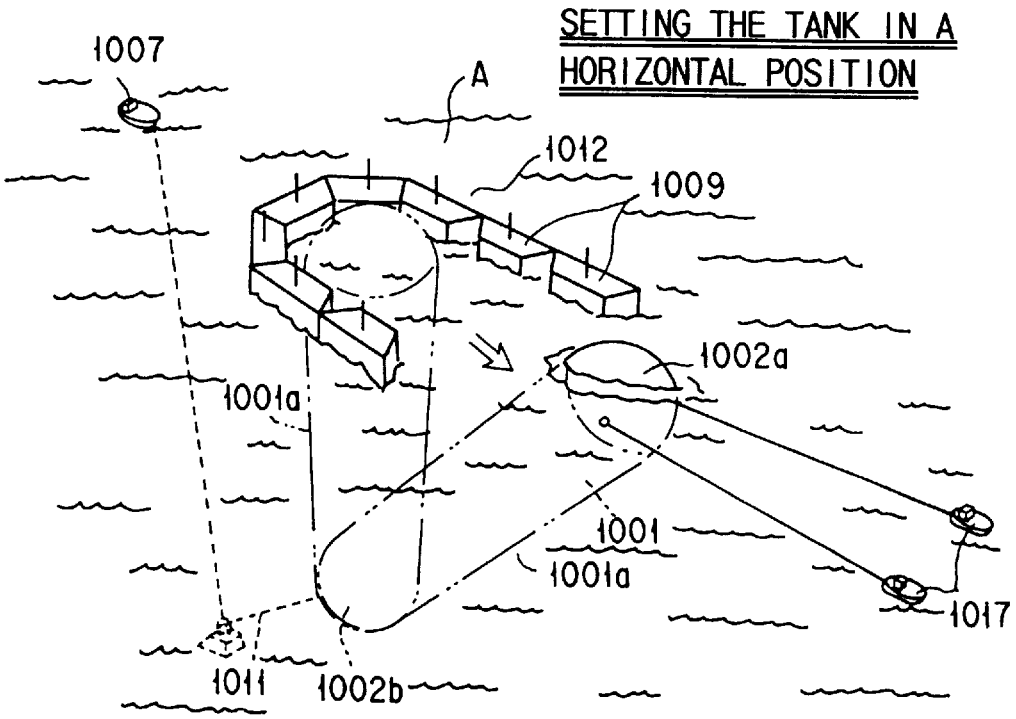
FIG. 8 is a perspective view illustrating the step of inclining the tank, from the standing position to a horizontal position, and then towing the tank from the floating station.

More specifically, after the large tank 1001*a* has been manufactured as shown in FIG. 8, some of the floats 1009 are moved, allowing the tank 100*a* to move. Water is poured into the ballast tank provided in the tank 1001*a*, thereby adjusting the buoyancy of the tank 1001*a*. The tugboats 1017 tow the tank 1001*a* at the top thereof while the buoyancy is being adjusted. The large tank 1001*a* is thereby inclined from the vertical position to a horizontal position, while floating on the sea.

Figure 9:
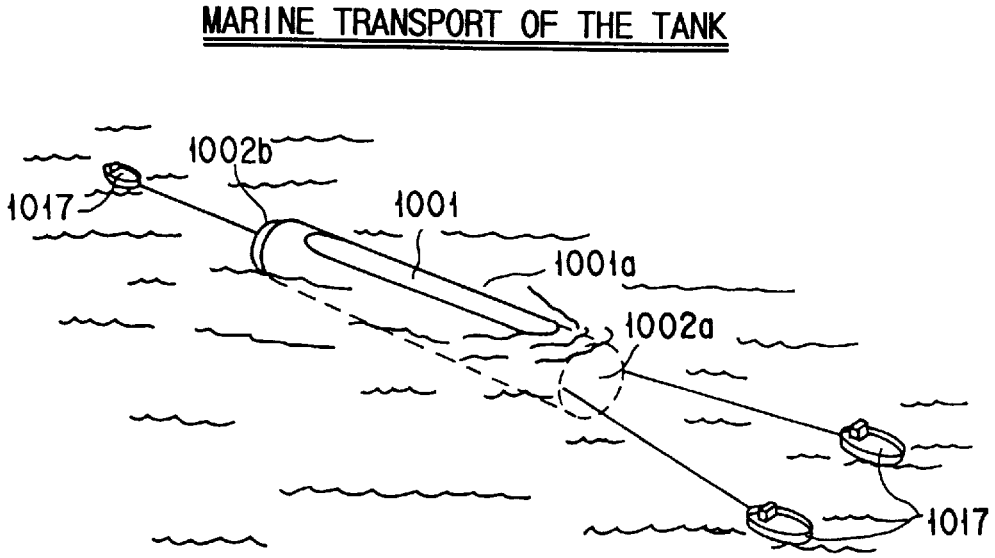
FIG. 9 is a perspective view explaining the step of transporting the tank now assuming the horizontal position, toward an installation site.
Figure 10:
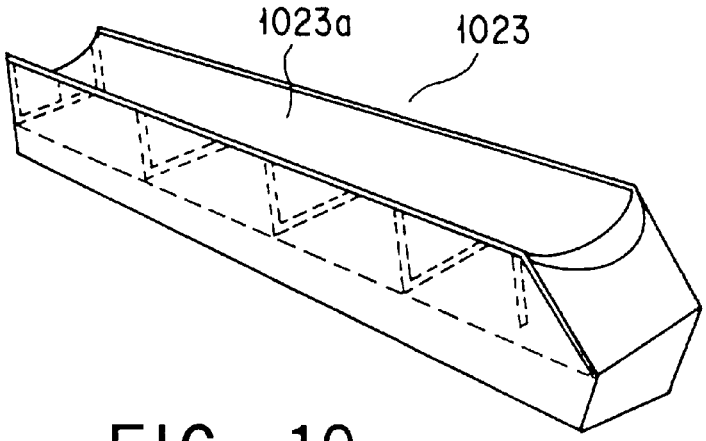
FIG. 10 is a perspective view of a tank base for supporting the tank at the seabed.

After the tank has been inclined, the tugboats 1017 tow the large tank 1001*a* to an installation site as shown in FIG. 9, while maintaining the tank 1001*a* in the horizontal position.

At the installation site on the sea, floating cranes 1020 and buoys 1028 support the whole tank. Water is poured into the ballast tank incorporated in the tank, thereby submerging the tank into the sea. The floating cranes 1020 guide the large tank 1001*a* to the tank base 1023, fitting the tank 1001*a* into the recess 1023*a* of the tank base 1023. The large tank 1001*a* is thereby installed on the seabed, in a horizontal position.

The above-mentioned method of building the large tank 1001*a* on the sea while held in a vertical position can use a large space available on the sea. Therefore, the tank 1001*a* can be built without such restrictions as are imposed when a tank is built on the ground, for example, in a dock.

With the method described above, it is therefore possible to build a gigantic tank 1001*a* having a length of 100 m or more, which can hardly be built on the ground. For example, a tank having a diameter of 100 m and a length of 400 m can be built by the method.

Since the tank 1001*a* is built on the sea, it can easily be inclined from a vertical position to a horizontal position, merely by pouring water into the tank 1001*a*. Further, it is easy to install the tank 1001*a* on the seabed, only by towing the tank to the installation site and then submerged onto the tank base 1023 already secured to the seabed.

It is of course unnecessary to tow the large tank 1001*a* at all if the tank 1001*a* has been built at the installation site. Water only needs to be introduced into the ballast tank provided in the tank, thus submerging the tank onto the tank base 1023, whereby the tank 1001*a* is installed on the seabed.

As described above in detail, it is possible with the present invention to built a gigantic tank to be installed on the seabed, which has, for example, a diameter of 100 m and a length of 400 m.

Embodiment 2

A combined system for deep-sea power storage and carbon dioxide dissolution, according to the second embodiment of the invention, will be described.

Figure 14:
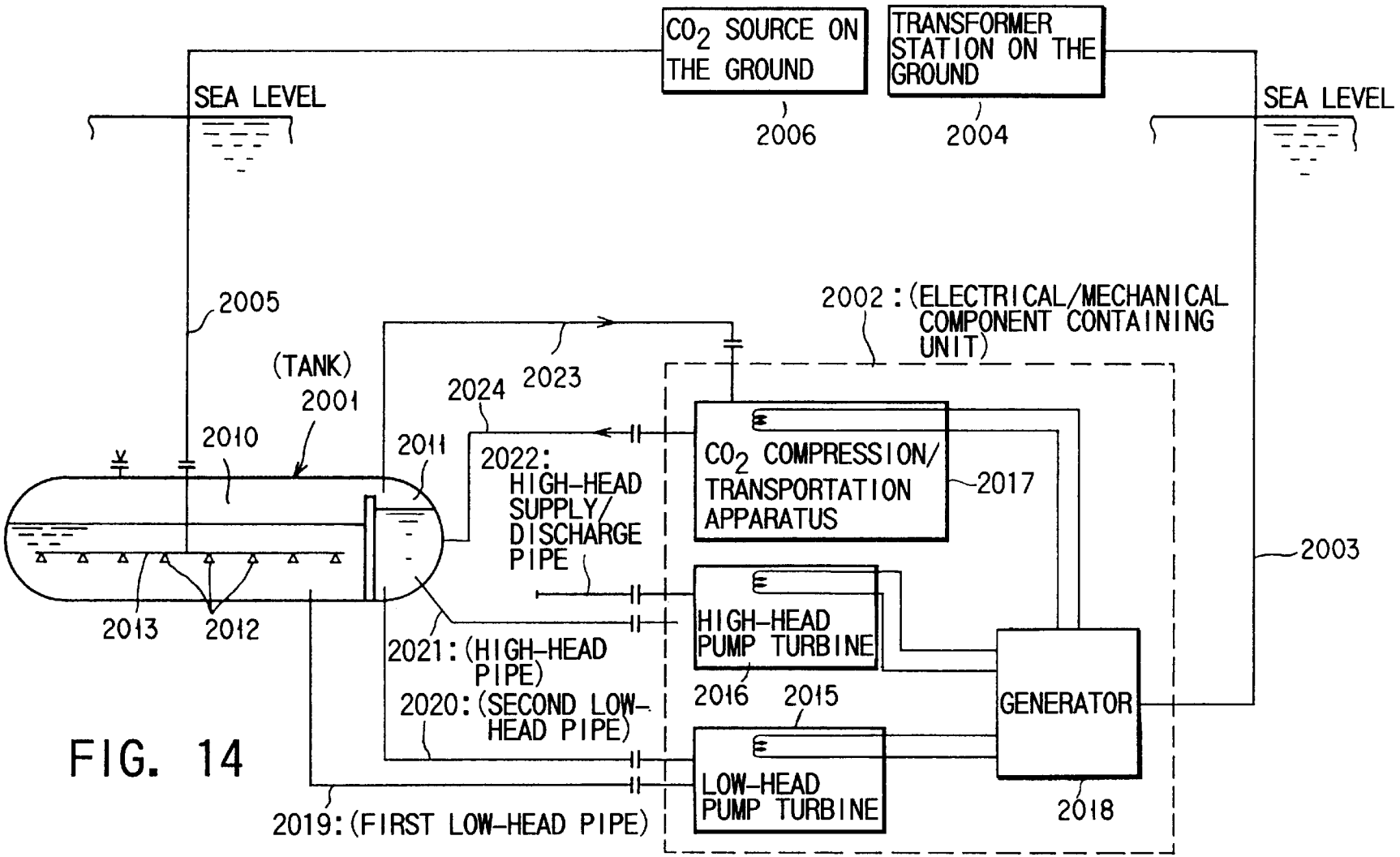
FIG. 14 is a diagram showing a combined system for deep-sea power storage and carbon dioxide dissolution.
Figure 15:
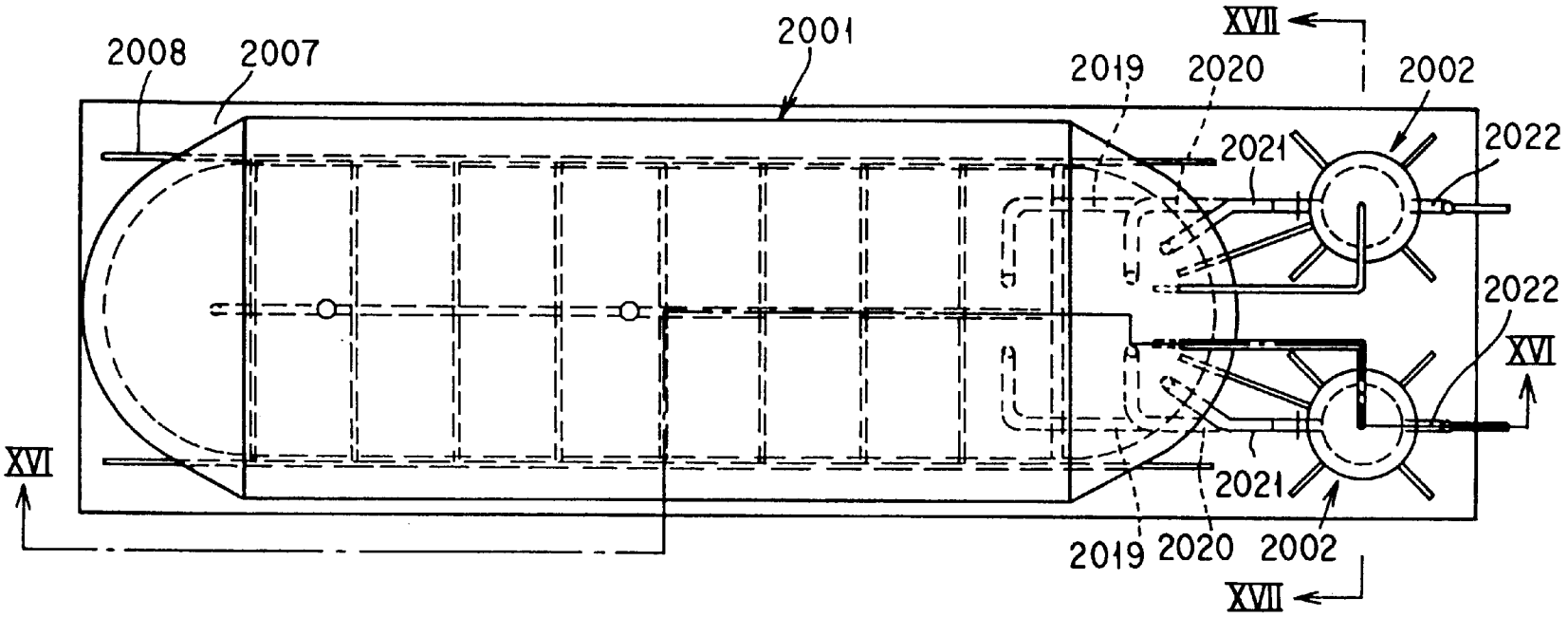
FIG. 15 is a plan view illustrating the tank and the electrical/mechanical component units, all incorporated in the system shown in FIG. 14.
Figure 16:
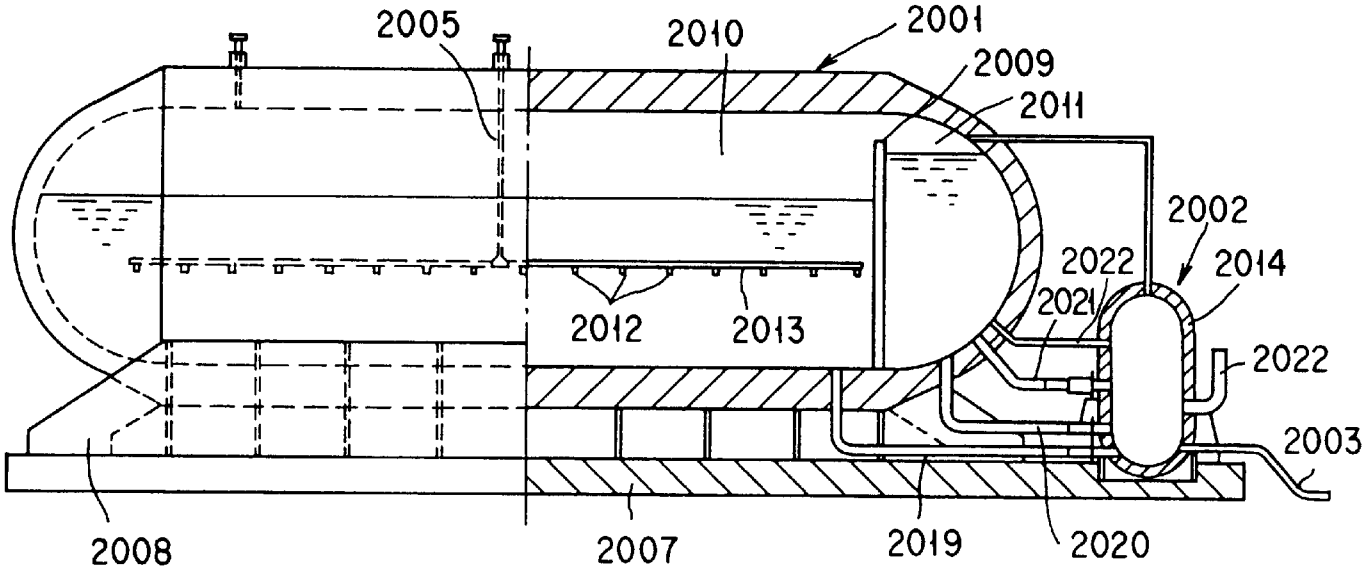
FIG. 16 is a sectional view taken along line III—III shown in FIG. 15.
Figure 17:
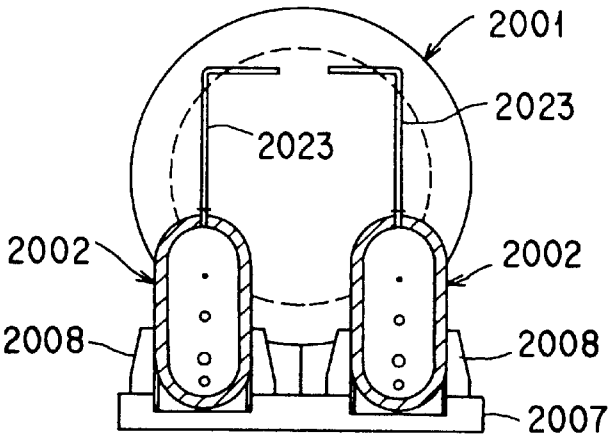
FIG. 17 is a sectional view taken along line IV—IV shown in FIG. 15.

FIG. 14 shows the combined system for deep-sea power storage and carbon dioxide dissolution. FIG. 15 is a plan view illustrating a tank and electrical/mechanical component units incorporated in the system shown in FIG. 14. FIG. 16 is a sectional view taken along line III—III shown in FIG. 15. FIG. 17 is a sectional view taken along line IV—IV shown in FIG. 15.

As shown in FIG. 15, the combined system comprises a tank 2001 and a plurality of electrical/mechanical component units 2002, a transformer section 2004, and a carbon dioxide source 2006. For example, two electronic component units 2002 are provided adjacent to the tank 2001. The transformer section 2004 is installed on the ground and connected to the units 2002 by a submarine cable 2003, for controlling the power storage and power generation performed in each unit 2002. The carbon dioxide source 2006 is provided on the ground and connected to the tank 2001 by a carbon dioxide pipeline 2005, for applying carbon dioxide into the sea water contained in the tank 2001.

As shown in FIGS. 15 to 17, the tank 2001 is laid on a tank base 2008 secured to a mound 2007 which is built on the seabed. The tank 2001 is a cylindrical one. It has a steel-concrete (SC) structure comprising two steel walls and concrete filled in the gap between the steel walls.

A partition 2009 is provided in the tank 2001, near the right end thereof. The upper edge of the partition 2009 is spaced apart from the ceiling of the tank 2009. The partition

2009 divides the interior of the tank 2001 into low-head section 2010 and a high-head section 2011.

A carbon dioxide applying pipe 2013 having a plurality of nozzles 2012 is provided in the low-head section 2010 of the tank 2001. The pipe 2013 extends horizontally over its entire length so as to be immersed in the sea water contained in the low-head section 2010. The pipe 2013 is coupled, at its middle portion, to the carbon dioxide pipeline 2005.

As FIGS. 15 to 17 show, the electrical/mechanical component units 2002 have a pressure-resistant vessel 2014 each. The vessels 2014 are laid on the tank base 2008 that is secured to the mound 2007 built on the seabed.

Each pressure-resistant vessel 2014 is shaped like a capsule. It has a steel-concrete (SC) structure comprising two steel walls and concrete filled in the gap between the steel walls and can therefore withstand the pressure in the deep sea. As shown in FIG. 14, each pressure-resistant vessel 2014 contains a low-head pump turbine 2015, a high-head pump turbine 2016, a carbon dioxide compressing/supplying apparatus 2017 and a generator 2018. The generator 2018 is connected to both turbines 2015 and 2016 and also to the compressing/supplying apparatus 2017.

The generator 2018 is connected by the submarine cable 2003 to the transformer section 2004 provided on the ground.

The first low-head pipe 2019 is connected at one end to the lower side of the low-head section 2010 of the tank 2001. The pipe 2019 is connected at the other end to a port which functions as an inlet port when the low-head pump turbine 2015 operates to store power.

The low-head pipe 2020 is connected at one end to the lower side of the low-head section 2010 of the tank 2001. The low-head pipe 2020 is connected at the other end to a port which functions as an outlet port when the low-head pump turbine 2015 operates to store power.

The high-head pipe 2021 is connected at one end to the lower side of the high-head section 2011 of the tank 2001. The pipe 2021 is connected at the other end to a port which functions as an intake port when the high-head pump turbine 2016 operates to store power.

The high-head supply/discharge pipe 2022 is connected at one end to a port which serves as an outlet port when the high-head pump turbine 2016 operates to store power. The pipe 2022 opens to the deep-sea side.

One valve is provided on each of the pipes 2019 to 2022. A carbon dioxide supply pipe 2023 communicates at one end with the interior of the tank 2001 in the side of the high head section side and is connected at the other end to the carbon dioxide compressing/supplying apparatus 2017 provided in the pressure-resistant vessel 2014.

A carbon dioxide return pipe 2024 is connected at one end to the carbon dioxide compressing/supplying apparatus 2017 and at the other end to the bottom of the high-head section 2011 of the tank 2001.

With reference to FIGS. 14 to 17, it will now be explained how the combined system composed of a deep-sea power storage unit and a carbon dioxide dissolution unit operates to 1) generate electric power and 2) store electric power.

1) Power Generation

When the valve on the high-head supply/discharge pipe 2022 is opened while a space remains above the level of the sea water in the tank 2001, thus maintaining a water-head difference therein, the sea water rushes at high speed onto the pump turbine 2016 provided in the electrical/mechanical component units 2002. The sea water so rushes due to the difference between the pressure in the deep sea and the pressure in the space existing in the tank 2001. As a result, the turbine 2016 rotates at high speed.

After passing from the turbine 2016, the sea water flows into the high-head section 2011 of the tank 2001 through the high-head pipe 2021. The sea water rushes from the high-head section 2011 onto the low-head pump turbine 2015 in the electrical/mechanical component unit 2002 through a second low-head pipe 2020. The sea water so rushes because of the difference between the water head in the tank 2001 and the water head in the low-head section 2010. The turbine 2015 is thereby rotated at high speed.

After turning the turbine 2015, the sea water flows through the first low-head pipe 2019 into the low-head section 2010 of the tank 2001. As the turbines 2015 and 2016 rotate swiftly, the generator 2018 incorporated in the electrical/mechanical component unit 2002 generates electric power. The electric power, thus generated, is supplied through the submarine cable 2003 to the transformer section 2004 which is provided on the ground.

When sea water accumulates to a predetermined amount in the low-head section 2010 and high-head section 2011 of the tank 2001, the valve on the high-head supply/discharge pipe 2022 is closed.

2) Power Storing

Power is supplied from the transformer section 2004 on the ground, to the low-head pump turbine 2015 and the high-head pump turbine 2016 through the submarine cable 2003 and the generator 2018 of the electrical/mechanical component unit 2002.

When these turbines 2015 and 2016 are rotated in the reverse direction, sea water is pumped upwards from the low-head section 2010 of the tank 2001. The sea water is thereby supplied into the high-head section 2011 of the tank 2001 through the first low-head pipe 2019, the low-head pump turbine 2015, and the second low-head pipe 2020.

At the same time, sea water is discharged into the deep sea from the high-head section 2011 of the tank 2001 through the high-head pipe 2021, the high-head pump turbine 2016 and the high-head supply/discharge pipe 2022.

At this time, sea water is supplied to the high-head pump turbine 2016 through the high-head pipe 2021. The water level in the inlet port of the turbine 2016 is raised. The difference between the pressures in the inlet and outlet ports of the turbine 2016 is therefore reduced. Hence, the carbon dioxide dissolved in the sea water contained in the tank 2001 is gasified in the inlet port of the turbine 2016. The resultant gas can prevent the turbine 2016 from causing cavitation.

The combined system stops storing power when the surface of the sea water in the low-head section 2010 of the tank 2001 falls to a prescribed low level. Some of the surplus power available at night, for example, is supplied to the pump turbines 2015 and 2016 through the submarine cable 2003 from the transformer section 2004 installed on the ground.

While electric power is being generated, the carbon dioxide (e.g., carbon dioxide gas) is supplied from the carbon dioxide source 2006 provided on the ground to the tank 2001 through the carbon dioxide pipeline 2005, carbon dioxide applying pipe 2013 and nozzles 2012. The gas is applied into the sea water contained in the tank 2001 (the low-head section 2010). The carbon dioxide gas is stirred as the sea water level rises in the low-head section 2010. The gas can therefore be diluted and dissolved in the sea water.

While the electric power is being stored, the carbon dioxide dissolved in the sea water contained in the tank 2001 is released into the deep sea through the high-head supply/discharge pipe 2022. Thus, the carbon dioxide can be diluted and then released into the sea water.

In the case where carbon dioxide gas exists in the space above the sea water in the tank 2001, the gas is supplied through carbon dioxide supply pipe 2023 to the carbon dioxide compressing/supplying apparatus 2017 which is driven by the power supplied from the generator 2017. The carbon dioxide compressing/supplying apparatus 2017 liquefies the carbon dioxide gas.

The liquefied carbon dioxide is supplied to the high-head section 2011 of the tank 2001 through the carbon dioxide return pipe 2024. The carbon dioxide is dissolved into the sea water contained in the high-head section 2011.

Therefore, all carbon dioxide supplied to the low-head section 2010 of the tank 2001 can be diluted with sea water and released into the deep sea.

In the combined system for deep-sea power storage and carbon dioxide dissolution, surplus power available on the ground can be supplied at night from the transformer section 2004 to the pump turbines 2015 and 2016 of the electrical/mechanical component unit 2002 via he submarine cable 2003. The sea water can therefore be discharged from the tank 2001 into the deep sea through the high-head supply/discharge pipe 2022.

The energy resulting from the difference between the sea level and the sea water level in the tank 2001 (i.e. water-head difference) is utilized to store electric power. In the day when the power consumption is at its peak, sea water is taken from the deep sea through the high-head supply/discharge pipe 2022 and pumped into the high-head section 2011 of the tank 2001 through the high-head pipe 2021 by means of the high-head pump turbine 2016.

The sea water in the high-head section 2011 of the tank 2001 is poured into the low-head section 2010 of the tank 2001 through the second low-head pipe 2020 and the first low-head pipe 2019, by means of the low-head pump turbine 2015. The sea water thus accumulated is used, rotating the pump turbines 2015 and 2016, whereby electric power is generated.

The electric power, thus generated, can be supplied through the submarine cable 2003 to the transformer section 2004 installed on the ground.

The carbon dioxide (e.g., carbon dioxide gas) is supplied from the carbon dioxide source 2006 provided on the ground, into the sea water contained in the low-head section 2010 of the tank 2001. The carbon dioxide can thereby be thoroughly dissolved into the great amount of sea water in the tank 2001.

Further, the carbon dioxide in the sea water contained in the high-head section 2011 can be diluted and released into the deep sea through the high-head supply/discharge pipe 2022, in the later process of storing electric power. As a result, carbon dioxide can be discarded without excessively raising the acidity of sea water around the combined system or excessively lowering the temperature of the sea water. Thus, the sea water discharged from the combined system would not affect marine ecology. Nor would it cause environmental changes.

Moreover, carbon dioxide, if supplied to the tank 2001 in the form of a liquid, is stirred and diluted in the large amount of sea water in the tank 2001 and is heated to a temperature near that of the sea water. Hence, the sea water discharged from the combined system in the process of storing power would not excessively lower the temperature of sea water around the combined system.

A negative pressure is generated in the tank 2001 after the electric power is stored. This makes it possible to recover the gas dissolved into the sea water, such as hydromethane, through the through the carbon dioxide pipeline 2005 and carbon dioxide applying pipe 2013.

As detailed above, the combined system for deep-sea power storage and carbon dioxide dissolution, according to the invention, can perform composite operation. Namely, it can store electric power in the deep sea, without causing the cavitation of the high-head pump turbine. It can also dissolve and discard carbon dioxide at low cost, without affecting marine ecology or causing environmental changes.

Embodiment 3

Figure 18:
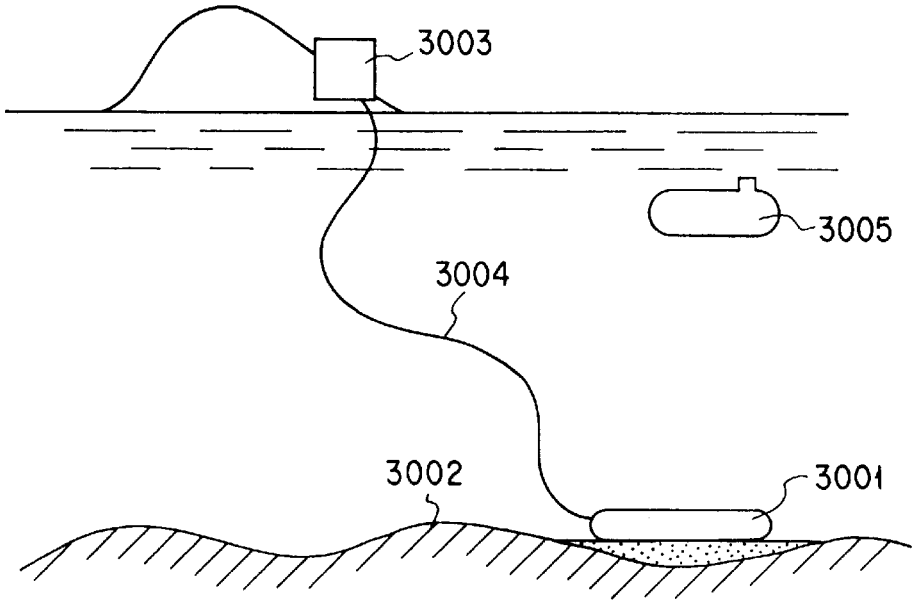
FIG. 18 is a diagram illustrating a deep-sea power storage system according to an embodiment of this invention.

FIG. 18 is a diagram illustrating a deep-sea power storage system according to the present invention. As shown in FIG. 18, the system comprises a system body 3001 installed on the seabed 3002.

The system body 3001 is connected by a submarine cable 3004 to a ground facility 3003 installed on the ground. An operator stationing in the ground facility 3003 remotely controls the system body 3001, thereby accomplishing maintenance work including routine inspection and routine oiling, causing the system body 3001 to dive and float, and switching the operating mode between the power-generating mode and the power-storing mode.

In the figure, numeral 3005 designates a support diving vehicle, in which the personnel perform maintenance on the system body 3001 immediately after the body 3001 has been installed.

Figure 19:
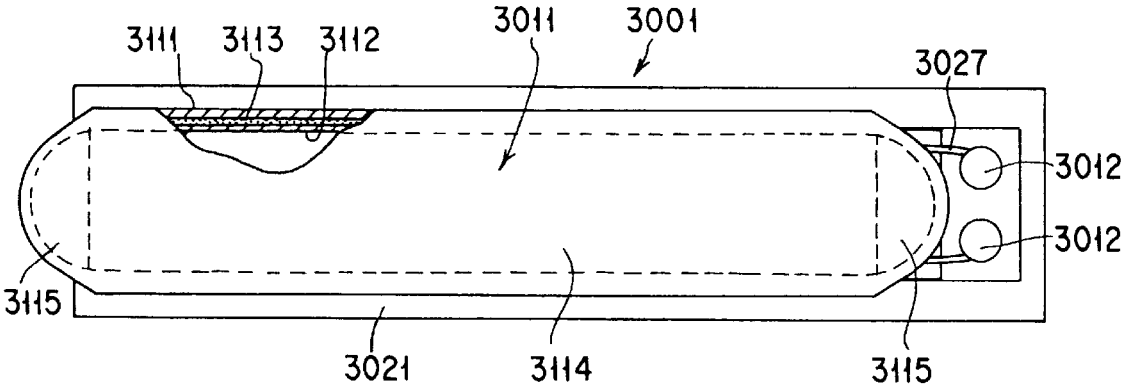
FIG. 19 is a diagram also showing the deep-sea power storage system according to the embodiment.

FIG. 19 shows the system body 3001. The system body 3001 has a battery tanks 3011 and electrical/mechanical component containers 3012 (two tanks as shown in FIG. 19). The battery tank 3011 and the electrical/mechanical component containers 3012 are placed on a mound 3021.

The battery tank 3011 is a large and long cylindrical one. It is of SC (Steel-Concrete) structure, comprising two cylinders 3111 and 3112. The cylinders are made of steel plates, constituting a double-wall cylinder. The gap between the two steel walls is filled with concrete.

The space in the middle portion of the battery tank is used as a tank body 3114. The end portions of the battery tank serve as ballast tanks 3115. The battery tank 3011 can float and dive, when sea water is discharged from, and poured into, the ballast tanks 3115.

Figure 20A:
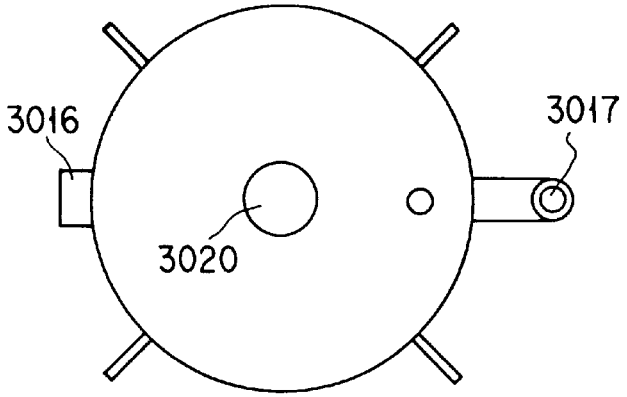
FIG. 20A is a diagram depicting an electrical/mechanical component container incorporated in the embodiment.
Figure 20B:
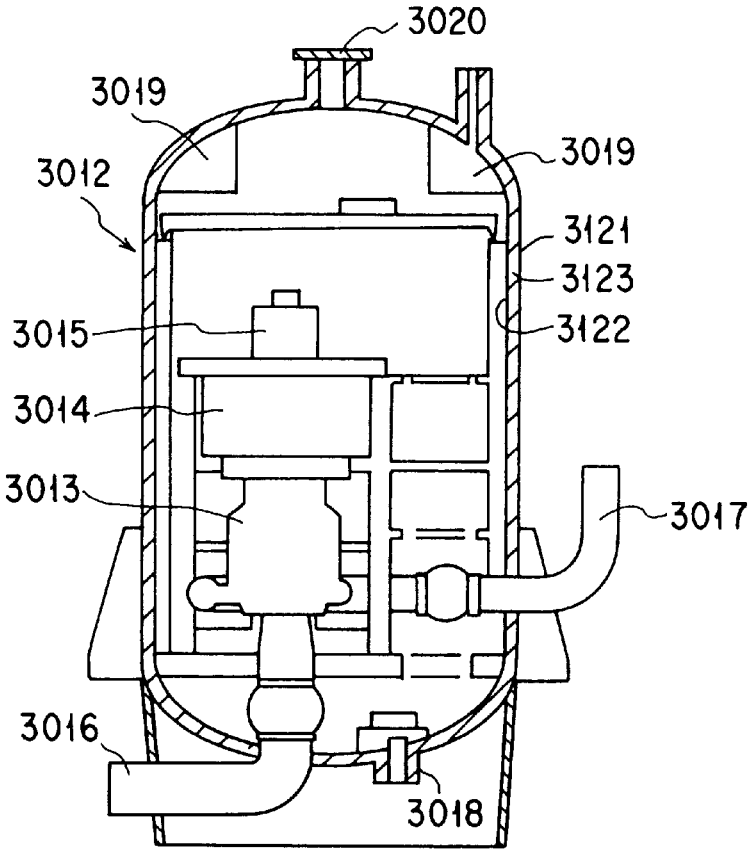
FIG. 20B is a sectional view of one electrical/mechanical component container incorporated in the embodiment.

As shown in FIGS. 20A and 20B, the electrical/mechanical component containers 3012 are vertical cylinders. Each is of SC (Steel-Concrete) structure, so as to withstand the pressure in the deep sea. Each container 3012 is made of steel plates, constituting a double-wall cylinder. The gap between the two steel walls is filled with concrete.

Provided in each electrical/mechanical component container 3012 are a pump turbine 3013, a generator 3014 and a motor 3015 which are vertically aligned. A connecting pipe 3016 extends from the bottom of the pump turbine 3013 toward the bottom of the container 3012. An inlet/outlet pipe 3017 extends from the side of the pump turbine 3013 into the sea.

An electric connector pipe 3018 protrudes downward from the bottom of the container 3012, guiding a power cable for supplying the power generated by the generator 3014 from the container 3014 and the power for driving the motor 3015. The motor 3015 can be dispensed with. If so, the generator 3014 is replaced by a motor generator.

A ballast tank 3019 is provided in the top section of each electrical/mechanical component container 3012. A manhole 3020 is made in the center part of the top of the container 3012. The personnel can enter and leave the electrical/mechanical component container 3012. The container 3012 can float and dive, when sea water is discharged from, and poured into, the ballast tank 3019.

Figure 21:
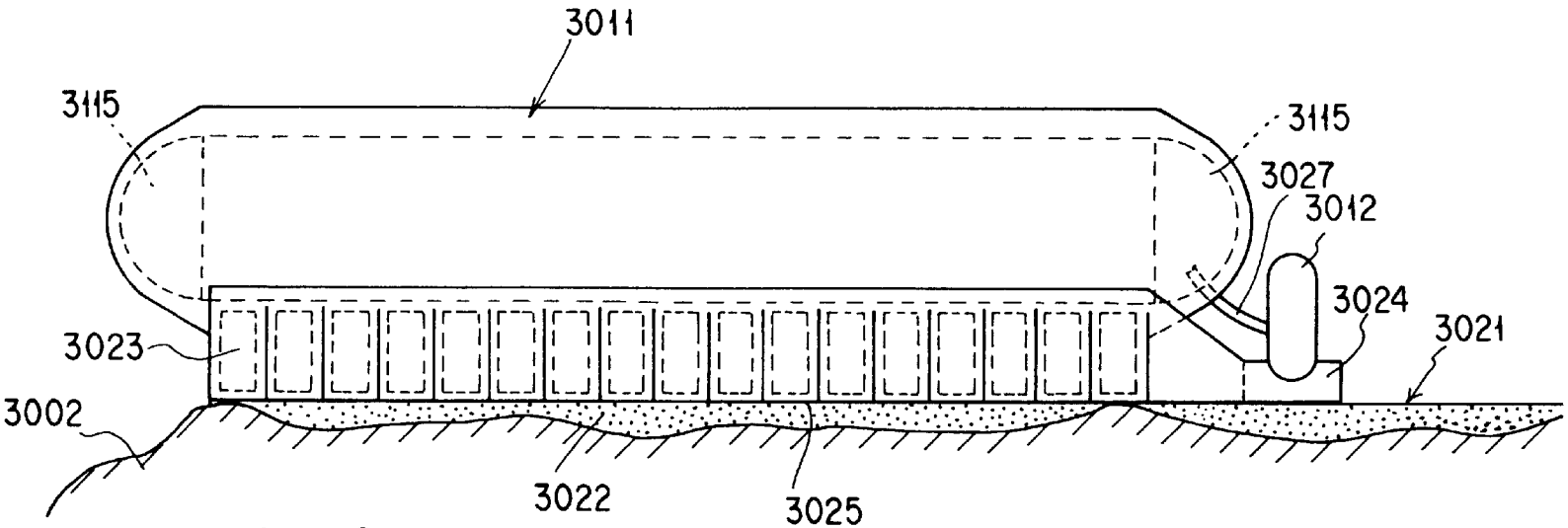
FIG. 21 is a diagram showing the conditions in which the power storage system according to the embodiment is laid on a mound.

FIG. 21 illustrates the conditions in which the system body 3001 is laid on the mound 3021.

The mound 3021 is constructed as follows. First, topsoil is removed from the undulating sea bottom 300 by means of a clove basket or the like. Then, a base made of an iron frame is lowered from a marine station and laid on the sea bottom, and its horizontal level is adjusted.

Further, unit bases 3023 and a unit base 3024 are laid on the mound 3021 thus formed. The battery tank 3011 is then mounted on the unit bases 3023. Also, the electrical/mechanical component containers 3012 are mounted on the unit base 3024.

In this case, the unit bases 3023 and 3024 have been prefabricated in a factory. They are placed on a hard rubber layer 3025 laid on the mound 3021, in surface contact therewith. The hard rubber layer 3025 mitigates seismic force, if any, which would otherwise be directly transmitted from the mound 3021 to the unit bases 3022 and 3024.

The unit bases 3023 for the tank have such a height that the lowest part of the battery tank 3011 is located at a level higher than the pump turbines 3013. Thus, the pump turbine 3013 in each electrical/mechanical component container 3012 can have an inlet head, in order to prevent cavitation.

Figure 22:
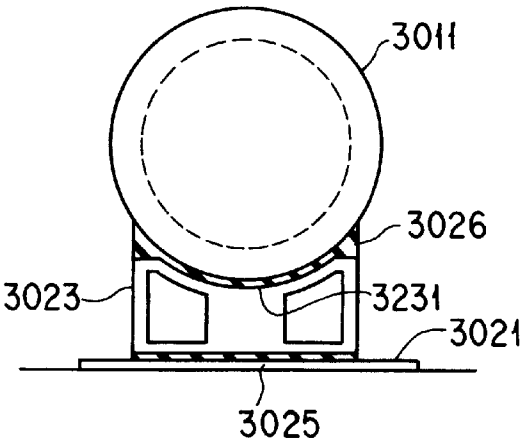
FIG. 22 is a diagram illustrating how a unit base supports the battery tank in the power storage system according to the embodiment.

As shown in FIG. 22, each unit base 3023 for the tank has a curved seat surface 3231. The unit bases 3023 can therefore support the big and heavy battery tank 3011, firmly at a predetermined elevation.

The battery tank 3011 is supported on the curved seat surface 3231 of each unit base 3023, at a its lower surface which extends in the circumferential direction for an angular distance of 60° on either side of the perpendicular intersecting with the axis of the tank 3011 (that is, a total angular distance of 120°).

Moreover, a hard rubber layer 3026 is interposed between the lower part of the battery tank 3011 and the curved seat surface 3231. The layer 3026 distributes the weight of the tank 3011 uniformly over the curved seat surface 3231.

The unit bases 3023 supporting the tank are arranged along the longitudinal axis of the battery tank 3011.

Figure 23A:
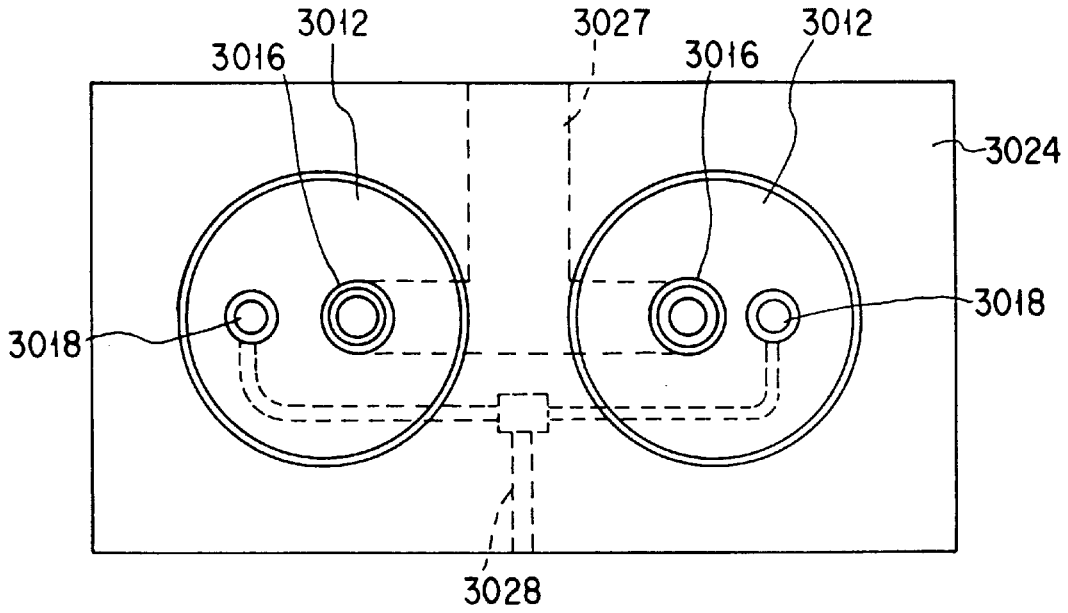
FIG. 23A is a diagram showing the unit base supporting containers in the power storage system according to the embodiment.
Figure 23B:
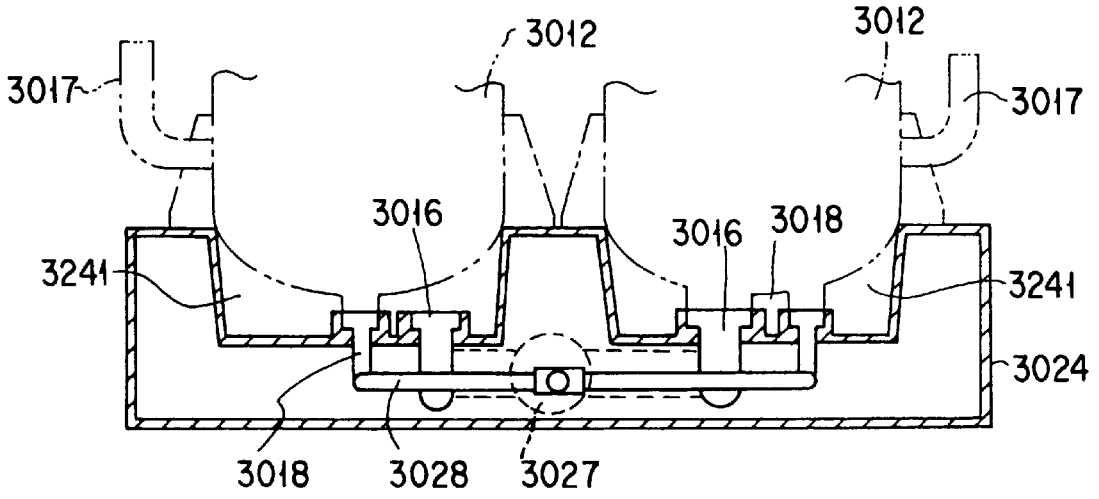
FIG. 23B is a sectional view showing the unit base for supporting the containers, in the power storage system according to the embodiment.

As shown in FIGS. 23A and 23B, the unit base 3024 supporting the containers has U-shaped mounts 3241, on which the electrical/mechanical component containers 3012 are placed.

A connecting pipe 3027 and a submarine-cable-connecting pipe 3028 are laid below the bottoms of the mounts 3241. The connecting pipe 3016 extending from the bottom of each electrical/mechanical component container 3012 placed on the mount 3241 is connected to the connecting pipe 3027 by a coupler.

Similarly, the electric connector pipe 3018 protruding from the bottom of the container 3012 is connected to the submarine-cable-connecting pipe 3028 by a coupler.

The connecting pipe 3027 is connected to the battery tank 3011, to which the pump turbines 3013 are connected. The submarine cable 3004, which has been described with reference to FIG. 18, connects the submarine-cable-connecting pipe 2028 to the ground facility 3003.

The operation of the embodiment thus constructed will be explained.

First, the mound 3021 for supporting the system body 3001 is built. In this case, top soil is removed from the undulating sea bottom 302 located near the land and at a depth of about 800 m, by means of a clove basket. Then, a base made of an iron frame is lowered from a marine station. The base is laid on the sea bottom, and its horizontal level is adjusted.

Thereafter, underwater concrete 3022 is injected into the base from the marine station through a concrete pressure pipe. The mound 3021 having a flat top is thereby formed.

The unit bases 3023 for supporting the tank and the unit base 3024 for supporting the containers are placed on the mound 21.

In this case, the unit bases 3023 and the unit base 3024 are arranged in surface contact with the surface of the mound 3021, with the hard rubber layer 3025 interposed between each unit base and the mound 3021.

The layer 3025 may be made of hard rubber having a frictional coefficient of about 0.4 with respect to iron. If so, anything located above the unit bases 3023 and 3024 will only slide in case of earthquake that results in horizontal vibratory acceleration exceeding 0.4 G. The layer 3025 serves to mitigate the shock of an earthquake.

The battery tank 3011 is mounted on the unit bases 2023 for supporting the tank. The electrical/mechanical component containers 3012 are mounted on the unit base 2024 for supporting the containers.

Sea water is poured into the ballast tanks incorporated in the battery tank 3011. The tank 3011 is lowered into the sea by a floating crane or the like and placed on the curved seat surface 3231 of the unit base 3023. The tank 3011 is then connected to the connecting pipe 3027.

Similarly, sea water is poured into the ballast tanks provided in the electrical/mechanical component containers 3012. The containers 3012 are lowered into the sea by the floating crane or the like and placed on the U-shaped mounts 3241 of the unit base 2024. The containers thus positioned are connected to the connecting pipe 3027.

The electric connector pipe 3018 is connected to the submarine-cable-connecting pipe 3028 by a coupler.

The battery tank 3011 is so supported by the unit bases 3023 that it is located above the pump turbines 3013.

Therefore, an inlet head can be always maintained at the pump turbines 3013 in the electrical/mechanical component containers 3012, reliably preventing so-called cavitation. This is because sea water is discharged from the battery tank 3011 and the water level in the tank 3011 lowers in the tank 3011, creating a vacuum similar to water vapor above the surface of water in the tank 3011.

Each unit base 3023 supports a lower part of the battery tank 3011 at its curved seat surface 3231 which contacts the tank 3011. Further, the hard rubber layer 3026 is interposed between the lower part of the battery tank 3011 and the curved seat surface 3231, distributing the weight of the tank 3011 uniformly over the curved seat surface 3231. Thus, the battery tank 3011 can be firmly held even at a high elevation.

The system is operated in this condition. At night, the surplus power is supplied to the motors 3015 provided in the electrical/mechanical component containers 3012 through the submarine cable 3004 from the ground facility 3003, in accordance with instructions made in the ground facility 3003.

The pump turbines 3013 are driven, discharging sea water from the battery tank 3011 into the deep sea through the inlet/outlet pipe 3017 and the connecting pipe 3027. The electric power is thereby stored in the form of energy equivalent to the water head between the sea level and the water level in the battery tank 3011.

In the day when the power consumption is at its peak, sea water is taken from the deep sea through the inlet/outlet pipe 3017. The pump turbines 3013 are driven, pumping the sea water into the battery tank 3011 through the connecting pipe 3027. Electric power is thereby generated and supplied to the ground facility 3003 through the submarine cable 3004.

Repair and maintenance of the system body 3001 are performed on a three-level scheme, in accordance with the degrees of an accident.

First Level:

Routine inspection and oiling, carried out remotely in accordance with the instructions given from the ground facility 3003 while the system is normally operating.

Second Level

Repair and maintenance performed if the first-level repair and maintenance cannot obviate troubles in the body 3001. The personnel aboard the support diving vehicle 3005 go to the electrical/mechanical component containers 3012, move from the vehicle 3005 into the containers 3012 via the manholes 3029 thereof, and repair the malfunctioning components in the containers 3012.

Third Level

Repair and maintenance performed if the first-level or second-level repair and maintenance cannot obviate troubles in the body 3001. The ground facility 3003 gives instructions to the system body 3001, whereby sea water is discharged from the battery tank 3001 and/or from the ballast tanks 3115 and 3017 of the electrical/mechanical component container 3012. As a result, the battery tank 3001 and/or the containers 3012 float to the sea level, whereby the malfunctioning components in the tank 3001 and/or can be repaired.

As described above in detail, the invention can provide a deep-sea power storage system, which is resistive to seismic shocks, easy to repair and maintain, and can operate reliably.

Embodiment 4

Figure 24:
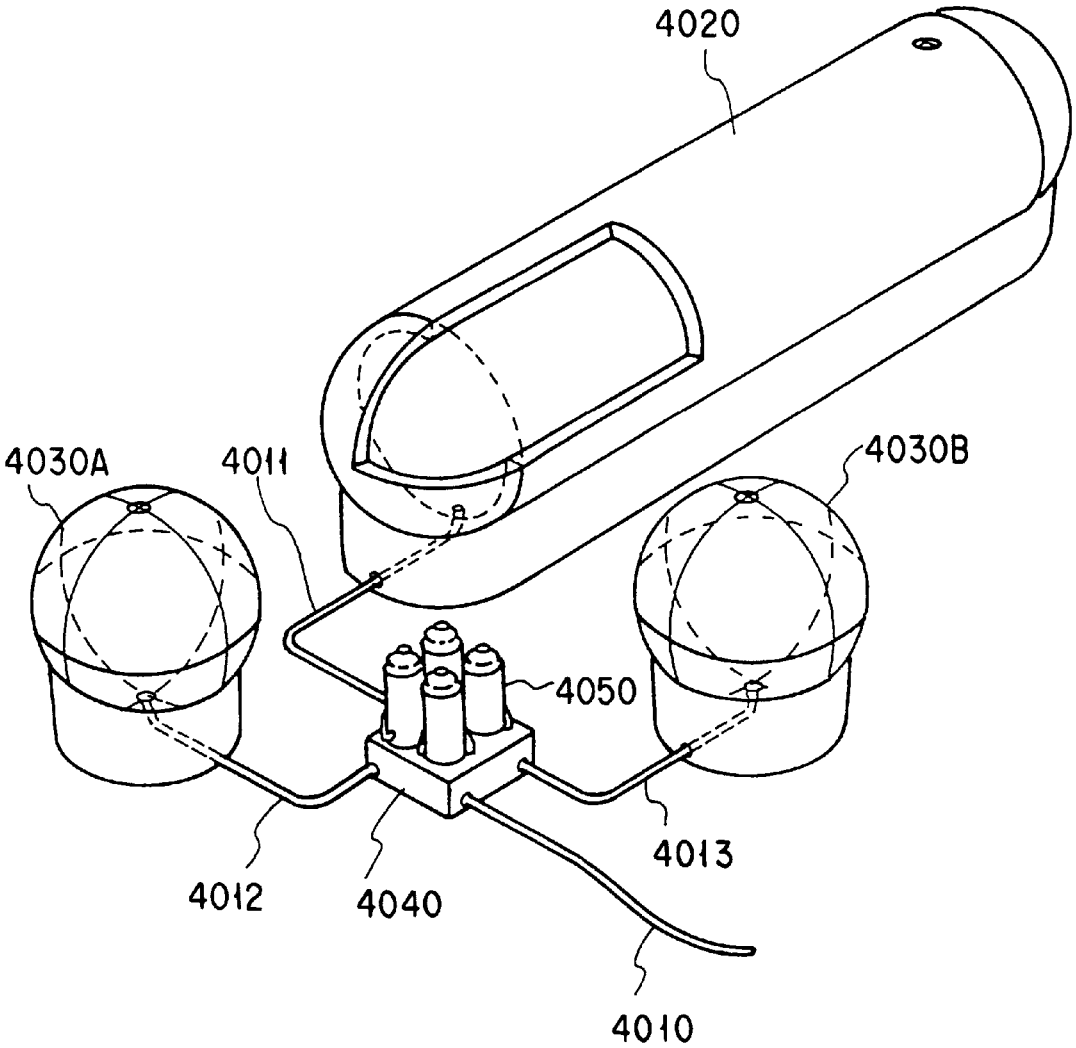
FIG. 24 is a perspective view showing a submarine power storage system according to an embodiment of the present invention.

FIG. 24 is a perspective view showing a submarine power storage system according to an embodiment of the present invention. In FIG. 24, numeral 4010 designates a submarine cable, numeral 4011 to 4013 denote connecting pipes, and numeral 4020 indicates a hollow cylindrical battery tank. Symbols 4030A and 4030B denote two spherical battery tanks, numeral 4040 indicates a unit base, and numeral 4050 designates electrical/mechanical component containers.

As shown in FIG. 24, the hollow cylindrical battery tank 4020 and the two spherical battery tanks 4030a and 4030B are connected to the unit base 4040 by the connecting pipes 4011, 4012 and 4013. The pipes 4011, 4012 and 4013 are provided to supply sea water.

A plurality of electrical/mechanical component containers 4050, each incorporating a pump turbine (not shown in FIG. 24), are mounted on the unit base 4040. The pump turbines provided in the electrical/mechanical component containers 4050 mounted on the unit base 4040 are connected to the battery tanks 4020,4030A, 4030B, respectively by the connecting pipes 4011, 4012 and 4013.

Figure 25A:
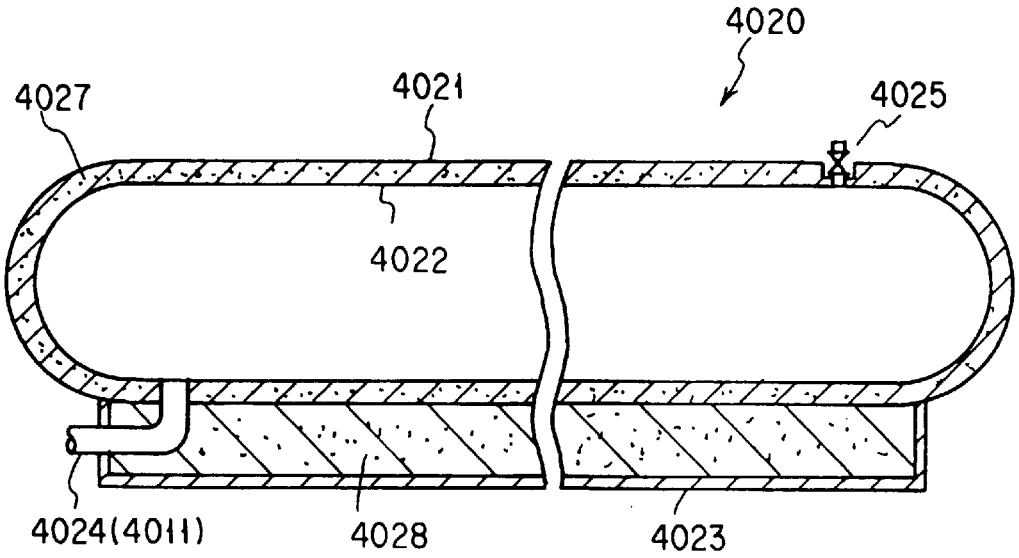
FIG. 25A is a sectional side view of the hollow cylindrical battery tank incorporated in the submarine power storage system according to the embodiment.
Figure 25B:
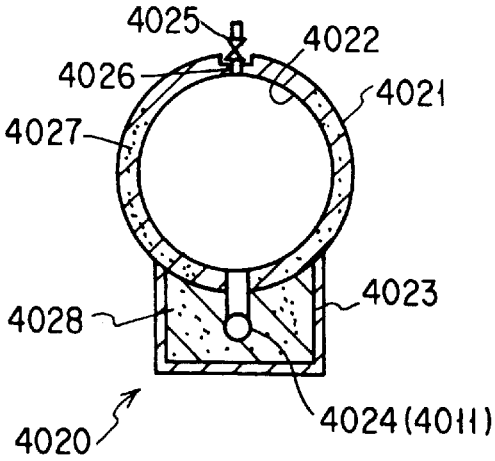
FIG. 25B is a sectional front view of the hollow cylindrical battery tank incorporated in the submarine power storage system according to the embodiment.

FIGS. 25A and 25B are a sectional side view and sectional front view, respectively, of the hollow cylindrical battery tank 4020. In FIGS. 25A and 25B, numeral 4021 designates an outer cylinder, numeral 4022 represents an inner cylinder, numeral 4023 denotes an anchor weight, and numeral 4024 indicates a connecting pipe. The cylinders 4021 and 4022 constitute a pressure vessel. The pipe 4024 (corresponding to the component 4011 shown n FIG. 24) connects the tank 4020 to the unit base. Also in FIGS. 25A and 25B, Numeral 4025 denotes a valve, numeral 4026 designates a purge pipe, numeral 4027 indicates high-strength concrete, and numeral 4028 denotes ordinary concrete.

Figure 26A:
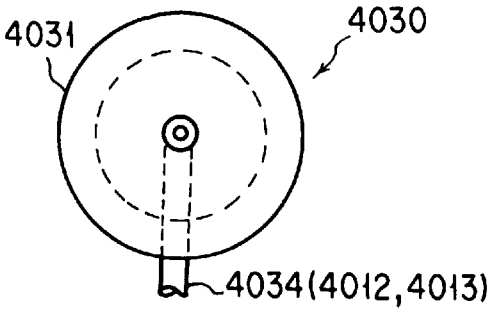
FIG. 26A is a plan view illustrating one of the spherical battery tanks used in the submarine power storage system according to the embodiment.
Figure 26B:
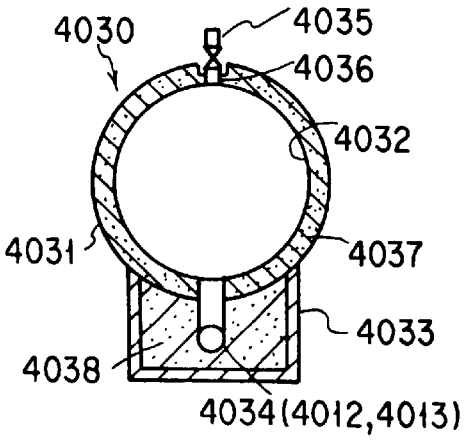
FIG. 26B is a sectional front view of one of the spherical battery tanks used in the submarine power storage system according to the embodiment.

FIGS. 26A and 26B are a plan view and sectional front view, respectively, of the tank 4030, i.e., one of the spherical battery tanks (4040, 4030A and 4030B). In FIGS. 26A and 26B, numeral 4031 denotes an outer cylinder, numeral 4032 indicates an inner cylinder, numeral 4033 denotes an anchor weight, and numeral 4034 designates a connecting pipe. The cylinders 4031 and 4032 constitute a pressure vessel. The pipe 4034 (corresponding to the components 4012 and 4013 shown in FIG. 24) connects the tank 4030 to the unit base. Also in FIGS. 26A and 26B, numeral 4035 denotes a valve, numeral 4036 designates a purge pipe, numeral 4037 indicates high-strength concrete, and numeral 4038 denotes ordinary concrete.

Figure 27A:
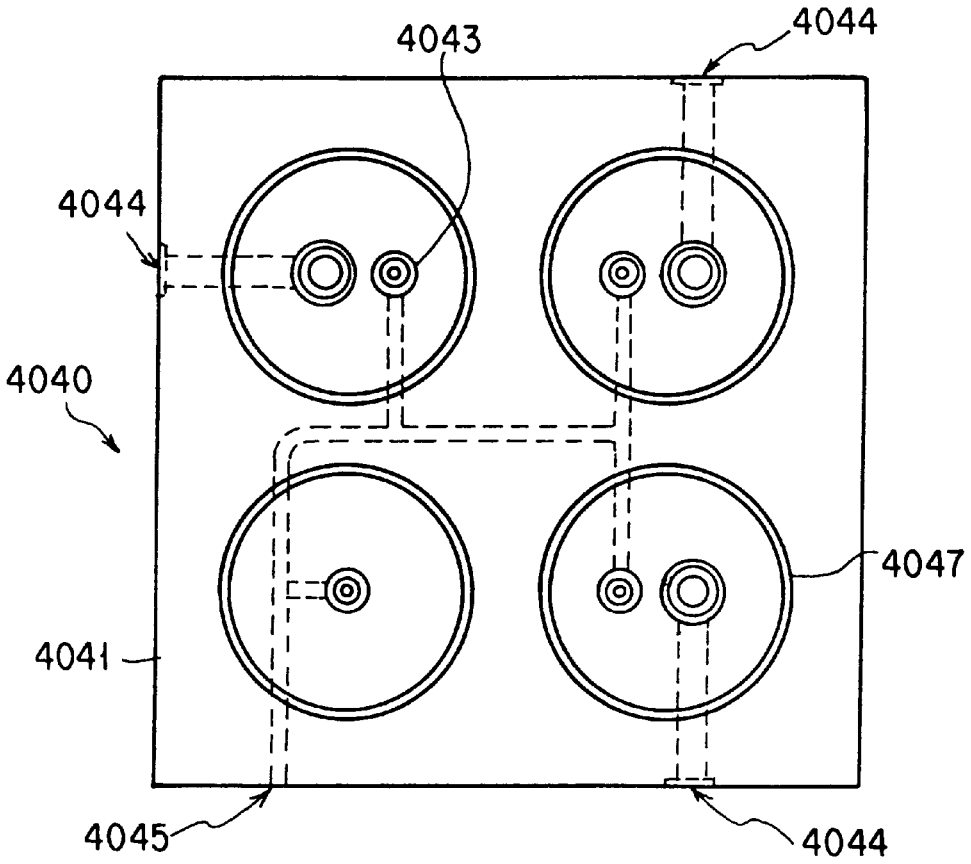
FIG. 27A is a plan view of the unit base of the submarine power storage system according to the embodiment.
Figure 27B:
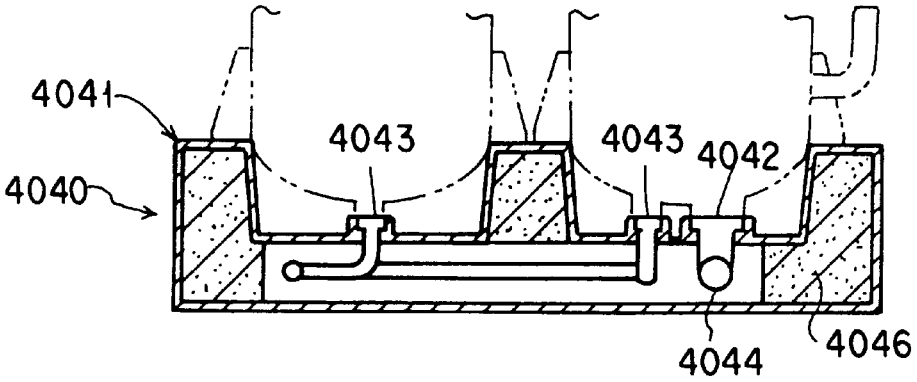
FIG. 27B is a sectional view of the submarine power storage system according to the embodiment.

FIGS. 27A and 27B are a plan view and sectional front view, respectively, of the unit base 4040. In FIGS. 27A and 27B, numeral 4042 denotes a connecting pipe, numeral 4043 indicates an electric-cable pipe, numeral 4044 designates pipe couplings, and numeral 4045 denotes a submarine-cable pipe.

The unit base 4040 has a main body 4041. A plurality of seats 4074, including spare seats, for supporting the electrical/mechanical component containers are provided on the top of the main body 4041.

To the pipe couplings 4044, the battery tanks 4020, 4030A and 4030B are detachably coupled at their ends.

Figure 28A:
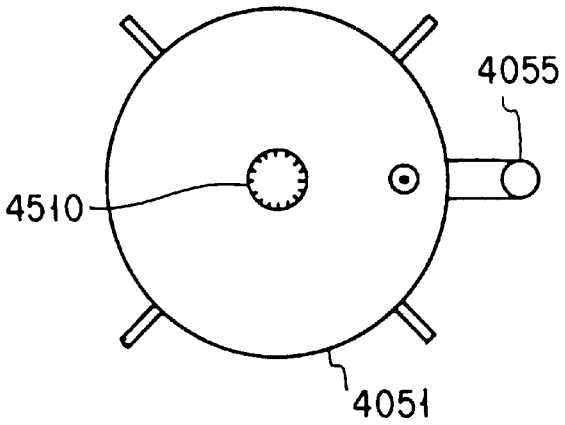
FIG. 28A is a sectional view showing the electrical/mechanical component containers incorporated in the submarine power storage system according to the embodiment.
Figure 28B:
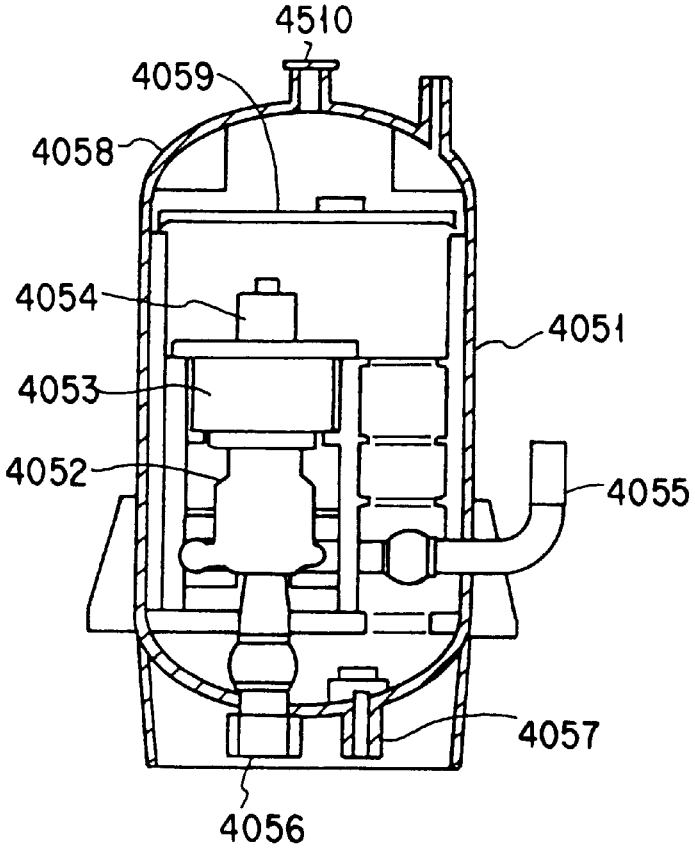
FIG. 28B is a sectional view illustrating one of the electrical/mechanical component containers provided in the submarine power storage system according to the embodiment.

FIGS. 28A and 28B are a plan view and sectional front view, respectively, of one electrical/mechanical component container 4050. In FIGS. 28A and 28B, numeral 4052 indicates a pump turbine, numeral 4053 denotes a generator, numeral 4054 represents a motor, and numeral 4055 designates an inlet/outlet pipe. Further, numeral 4056 denotes a connecting pipe, numeral 4057 represents an electric-cable pipe, numeral 4058 denotes a ballast tank, numeral 4059 designates a crane, and numeral 4510 indicates a hatch.

The electrical/mechanical component containers 4050 are placed at first on the seats 4047, not on the spare seats, of the unit base 4040. Each container 4050 incorporates a pump turbine 4052, a generator 4053, a motor 4054, and the like.

In the present embodiment, spare container seats, spare pipes and the like are provided in the unit base 4040. Furthermore, the battery tanks 4020, 4030A and 4030B are detachably coupled at their ends to the pipe couplings 4044 of the unit base 4040.

Therefore, additional battery tanks 4020, 4020A and 4030B can be used, if necessary during the commercial operation of the system, thereby to increase the power storage capacity.

Figure 29:
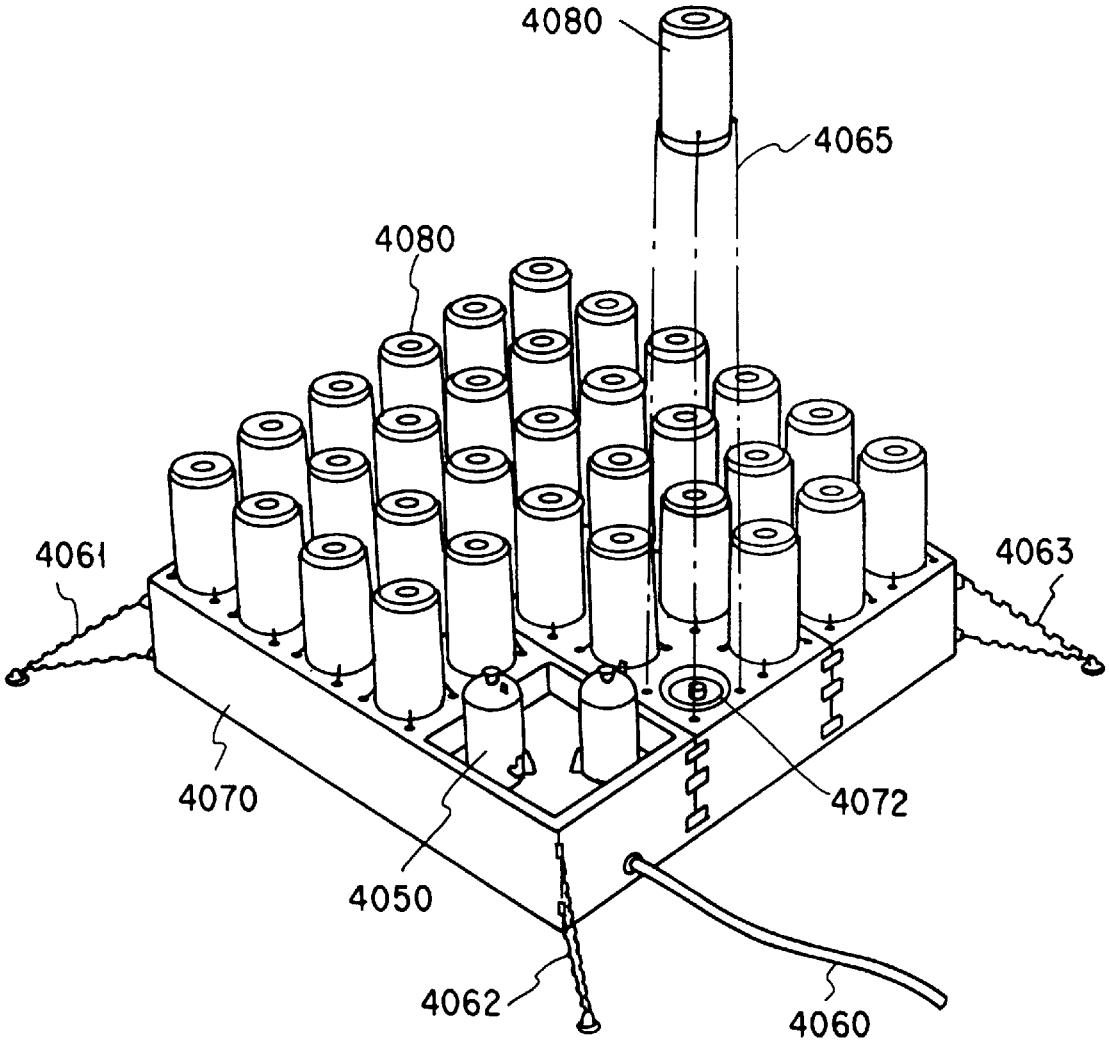
FIG. 29 is a perspective view showing a submarine power storage system according to a second embodiment of this invention.

FIG. 29 is a perspective view showing the unit base of a submarine power storage system, which is the second embodiment of this invention. In FIG. 29, numeral 4060 denotes a submarine cable, numerals 4061 to 4063 indicate anchors, numeral 4065 designates a wire rope, numeral 4070 indicates the unit base, numeral 4072 designates a spare container seat, and numeral 4080 represents vertical battery tanks.

Figure 30A:
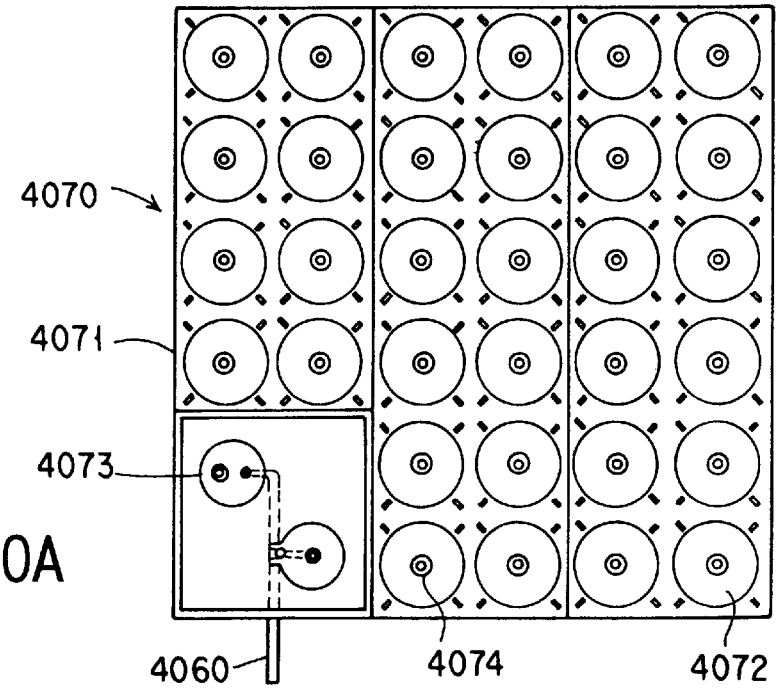
FIG. 30A is a plan view of the unit base used in the submarine power storage system according to the second embodiment.
Figure 30B:
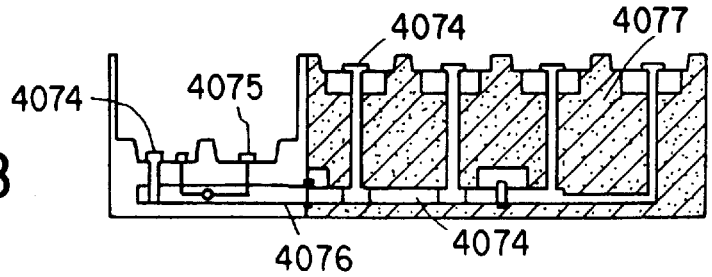
FIG. 30B is a sectional view of the unit base incorporated in the submarine power storage system according to the second embodiment.

FIGS. 30A and 30B are a plan view and sectional front view, respectively, of one unit base 4070. In FIGS. 30A and 30B, numeral 4072 designates a battery-tank seat and also a spare battery-tank seat, numeral 4073 denotes a seat for supporting the electrical/mechanical component container, numeral 4074 indicates connecting pipes, numeral 4075 represents electric connecting pipes, and numeral 4076 an electric cable pipe.

The unit base 4070 has battery-tank seats 4072, including spare ones, and a plurality of seats 4073, including spare ones, for supporting the electrical/mechanical component containers.

The vertical battery tanks 4080 are mounted directly on the unit base 4070. In the main body 4071 of the unit base 4070, the battery tanks 4080 are connected to the pump turbines provided in the electrical/mechanical component containers 4050 mounted on the unit base.

Figure 31A:
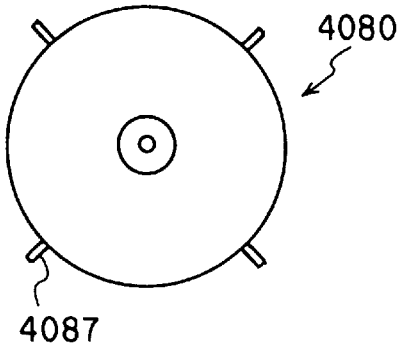
FIG. 31A is a plan view of the vertical (hollow cylindrical) battery tank incorporated in the submarine power storage system according to the second embodiment.
Figure 31B:
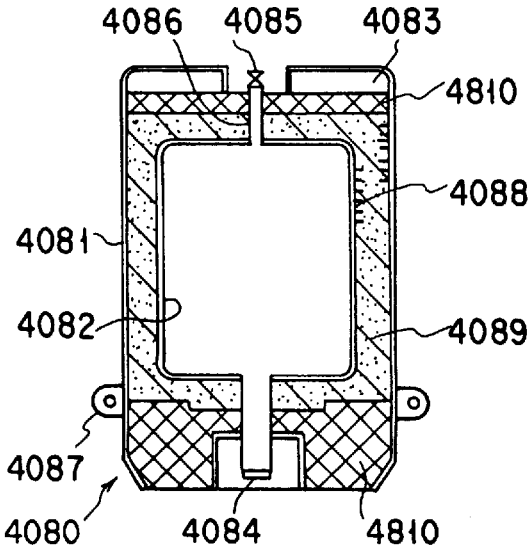
FIG. 31B is a sectional view of the vertical (hollow cylindrical) battery tank incorporated in the submarine power storage system according to the second embodiment.

FIGS. 31A and 31B are a plan view and sectional front view, respectively of one of the vertical (hollow cylindrical) battery tank 4080. In FIGS. 31A and 31B, numeral 4081 indicates an inner shell, numeral 4082 designates an outer shell, numeral 4083 denotes a buoyancy-adjusting tank, numeral 4084 indicates a water inlet/outlet port, and numeral 4085 denotes designates a valve. Numeral 4086 denotes a water-supplying pipe, numeral 4087 represents a fastening hook, numeral 4088 denote stud bolts, numeral 4089 indicates high-strength concrete, and numeral 4810 denotes ordinary concrete.

In this embodiment, a plurality of vertical battery tanks 4080 are mounted on the unit base 4070, along with a plurality of electrical/mechanical component containers 4050. The connecting pipes 4074 provided in the unit base 4070 connect the vertical battery tanks 4080 to the pump turbines 4052 which are incorporated in the electrical/mechanical component containers 4050.

The battery-tank seats 4072 shown in FIG. 30A includes spare ones. Therefore, additional vertical (cylindrical) battery tanks 4080 can be easily mounted on the unit base 4070, when it become necessary to do so in the future.

Features of the Embodiment

The embodiment described above is characterized in the following respects:

(1) The submarine power storage system according to the embodiment has a plurality of seats 4047 for supporting the electrical/mechanical component containers, and a unit base 4040 incorporating connecting pipe 4042 and an electric-cable pipe 4043. Each of the seats is connected to the ground facility by the cable 4010 and including a spare seat.

The system according to this embodiment has electrical/mechanical component containers 4050 mounted on all seats 4047 except the spare ones. Each of the containers 4050 incorporates a pump turbine 4052, a generator 4053, a motor 4054 and the like.

The system according to the embodiment still further comprises a plurality of battery tanks 4030, 4030A and 4030B which are pressure vessels and which are connected to the electrical/mechanical component containers 4050.

(2) The submarine power storage system according to the embodiment is of the type described in the paragraphs (1), characterized in that each of the battery tanks 4030, 4030A and 4030B has connecting pipes 4042 and 4043 which are coupled to the pipe couplings 4044 of the unit base 4040 and which can be disconnected therefrom.

(3) The submarine power storage according to the embodiment is of the type described in the paragraphs (1), in which the base unit 4070 has a plurality of seats 4073 supporting the electrical/mechanical component containers, including spare seats, and a plurality of seats 4072 supporting the battery tanks 4072, including spare seats.

The submarine power storage system according to the embodiment is characterized in that a plurality of battery tanks 4080 are arranged directly on the unit base 4070 and that the battery tanks are connected, in the unit base 4970, to the pump turbines 4052 incorporated in the electrical/mechanical component containers which are provided in the unit base 4070.

As described above in detail, the present invention can provide a submarine power storage system which can have its storage capacity increased even during the commercial operation.

Embodiment 5

Figure 32:
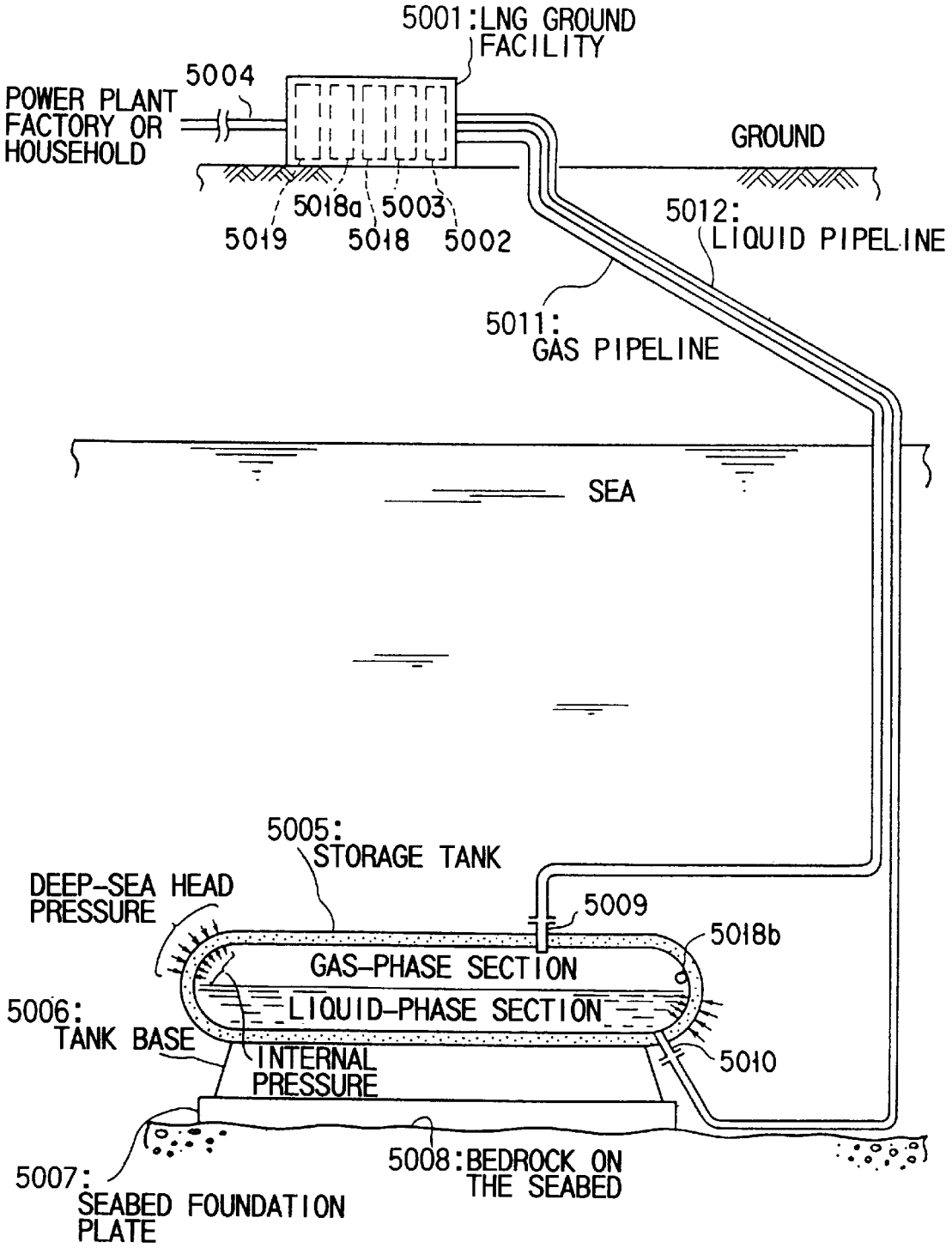
FIG. 32 is a diagram illustrating a submarine LNG storage system which is one embodiment of the present invention.

FIG. 32 is a diagram illustrating a submarine LNG storage system according to the present invention. In FIG. 32, numeral 5001 designates an LNG ground facility (equivalent to an LNG supply facility) installed on land, for example.

The LNG ground facility 5001 has a pump section 5002 for receiving and pumping LNG to be stored. The LNG ground facility 5001 further comprises a gasifying section 5003 for gasifying LNG into a high-pressure gas and adjusting the pressure of the gas to a desired value at which the gas is used. The LNG ground facility 5001 is connected to business facilities, such as power plants, factories, and households, by means of a line 50004.

Numeral 5005 denotes a cylindrical storage tank which is made of concrete and which is laid in a horizontal position on the ocellar plate 5008 at a depth of 500 m, in the vicinity of a city.

The storage tank 5005 made of has a large wall thickness. The thick wall made of concrete functions, by itself, as an effective heat insulator, without using any insulating material.

The tank 5005 is, for example, a large tank made of compressed concrete, which can withstand sea water pressure of 5.0 MPa when it is empty.

More particularly, the storage tank 5005 comprises an inner steel shell and an outer steel shell which oppose each other as is shown in FIG. 35. High-strength concrete (80 MPa) is deposited in the space between the outer steel shell 5005*x* and the inner steel shell 5005*y*, thus forming a concrete wall.

The tank 5005 has, for example, an inner radius r1 of 53.3 m, an outer radius r2 of 70.0 m, an overall length of 426.64 m. It is a horizontal cylindrical tank having storage capacity of about 3.3 million k/l.

The storage tank 5005 is laid on a horizontal tank base 5006, which is mounted on a foundation 5007 built on the ocellar plate 5008. The tank base 5006 has a size determined by the outer diameter of the storage tank.

The storage tank 5005 has been so laid, by pouring sea water into the ballast tanks 5005*a* attached to the tank 5005, while the entire tank 5005 is being held by means of, for example, a floating crane. The buoyancy of the tank 5005 is thereby adjusted, so that the tank 5005 is submerged into the sea until it rests in the curved surface 5006*a* of the base tank 5006.

Once the tank 5005 is thus installed on the seabed, an external compressing force that depends on the depth at which the tank is located is applied on the tank 5005. The tank therefore assumes the same state as a pre-stressed tank. In other words, no tensile stress generates in the concrete section of the storage tank 5005 even if the inner pressure rises to the same value as the external pressure.

By virtue of this specific behavior, the storage tank 5005 is stable in terms of strength even when it is in its critical state, whether empty or filled up with LNG, although the tank 5005 is made of concrete in a simple structure.

The storage tank 5005 has a gas inlet/outlet port 5009 in the upper part, and a liquid inlet/outlet port 5010 in the lower part.

The tank 5005 is connected to the LNG ground facility 5001 by two pipelines 5011 and 5012. Namely, the gas pipeline 5011 connects the gas inlet/outlet port 5009 to the facility 5001, while the liquid pipeline 5012 connects the liquid inlet/outlet port 5010 to the facility 5001.

Therefore, the storage tank 5005 can store the LNG supplied from the LNG ground facility 5001, and can supply natural gas to the LNG ground facility 5001, in the form of either gas or liquid.

Of the two pipelines 5011 and 5012, at least the liquid pipeline 5012 is of a multi-layered insulating structure, insulating LNG from the atmospheric temperature and the sea water temperature.

Figure 34:
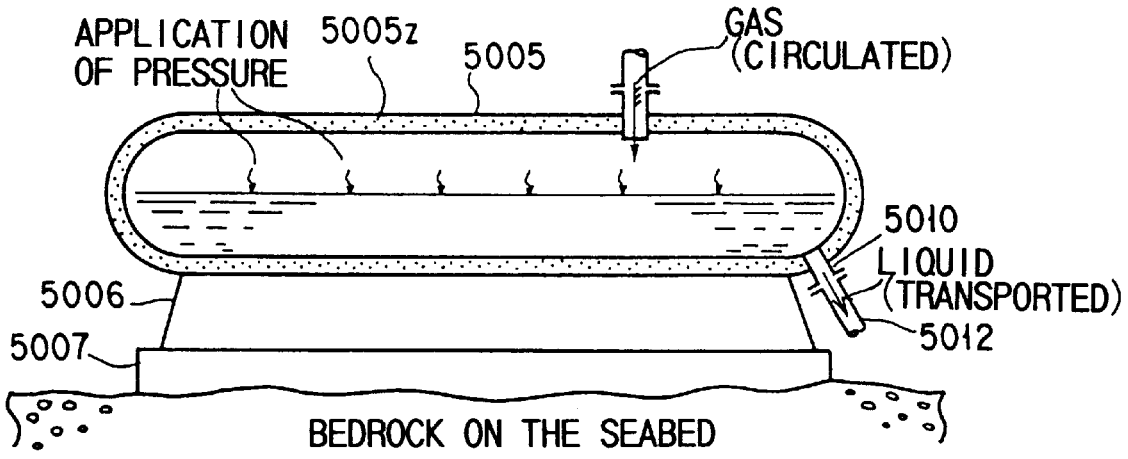
FIG. 34 is a partially sectional view explaining how a high-pressure gas is supplied into the tank (and circulated therein), thereby to supply LNG to the ground.

To be more specific, the liquid pipeline 5012 has the structure shown in FIG. 34. As shown in FIG. 34, the pipeline 5012 comprises an inner pipe 5013 and an outer pipe 5014 which are coaxial.

The pipeline 5012 further comprises an intermediate pipe 5015 between the pipes 5013 and 5014. The gap between the inner pipe 5013 and the intermediate pipe 5015 is filled with heat insulating material 5016, and the gap between the outer pipe 5014 and the intermediate pipe 5015 is filled with high-strength concrete 5017.

Thus, the pipeline 50112 is of a multi-layered structure, including a concrete layer made of high-strength concrete 5017. The pipeline can therefore insulate the interior from the sea water and the atmosphere.

The LNG ground facility 5001 has a suction section 5018 (equivalent to a cooling section) designed to draw the LNG gas from the upper part of the tank through the gas pipeline 5011, to gasify a part of the LNG, and to cool the LNG by utilizing the heat of evaporation.

Controlled by a control section 5018*a*, the suction section 5018 starts operating when the temperature detected by a sensor 5018*b* which monitors the temperature of LNG rises above a predetermined value. The section 5018 prevents the LNG temperature from increasing over a tolerable value.

The LNG ground facility 5001 further comprises a circulation section 5019 (i.e. a pump section). The section 5019 is designed to supply a part of the high-pressure gas generated in the LNG ground facility 5001, into the storage tank 5005 via the gas pipeline 5011, and also to circulate the high-pressure gas in the storage tank 5005.

In the submarine storage system thus constructed, the pump section 5002 in the LNG ground facility 5001 supplies LNG under pressure to the storage tank 5005 installed in the deep sea, near a city (e.g., at the depth of 500 m) through the gas pipeline 5011 and the liquid pipeline 5012. The system can thus store LNG, near the city, by utilizing the space available in the deep sea.

The storage tank 5005 installed in the deep sea is applied with a sea water pressure of 5.0 Mpa, assuming the same state as a pre-stressed tank. When LNG is pumped into the tank 5005, the compressing force on the concrete section is reduced. Therefore, no tensile stress generates in the concrete section at all.

The LNG can be pumped from the tank 5005 located at the depth of 500 m to the sea surface if a pressure of 3.5 MPa or more in the tank 5005 is applied in the tank, because LNG has a specific gravity of 0.72. At this time, the water pressure outside the tank is 5.5 MPa.

Hence, LNG can be pumped to the ground safely, without generating a tensile stress in the concrete tank, merely by applying a pressure of 3.3 to 5.0 MPa in the tank.

Installed in the deep sea, the storage tank 5005 can be strong enough in spite of its simple structure, solving the economical problem, which can hardly be solved with storage tanks built on the ground.

The main component of LNG is methane. The boiling point of methane is lower than that of any other component. If methane is liquefied, all other components will be liquefied.

Even if the temperature of LNG rises to the critical value of −82.5° C., LNG remains in liquid phase provided that a pressure equal to or higher than the critical pressure for methane is applied on the LNG. Thus, LNG can be liquefied at −82.5° C. since the tank is located in the sea at the depth of 500 and its inner pressure can be increased to 5 MPa.

FIG. 37 is a table showing the physical properties of LNG.

The heat leakage for one unit length of length of the cylindrical tank will be calculated. The amount Q/L of heat input in one unit of the sectional area of the hollow cylinder is:

$$Q/L=2\pi(\theta_1-\theta_2)/(1/\lambda)1n(r_2/r_1)$$

Where L is the length of the hollow cylinder, $r_1$ is 53.3 m, $r_2$ is 70.0 m, $\lambda$ is 0.8 to 1.4 w/m K(1.0) for high-strength concrete, $\theta_1$ is the temperature of LNG (−162° C.), $\theta_2$ is the temperature of sea water (4° C.).

Hence:

$$Q/L=2\pi(-162-4)/(1/1)1n(70/53.3)=3872w/m$$

The heat capacity T required for one unit of the sectional area of the hollow cylinder per temperature unit to gasify the LNG with water (in the case where the latent heat of evaporation cannot be expected to achieve cooling) is:

$$T=\pi\cdot r_1^2\cdot\rho\cdot C_P$$

Where ρ is the specific gravity of LNG, $C_P$ is the specific heat thereof (3.517 KJ/KgK).

$$T=\pi 53.3^2\cdot 0.72\cdot 10^3\cdot 3.517$$

$$=2.26\cdot 107KJ/(K\cdot m)$$

$$=2.26\cdot 10^{10}W\cdot SEC/(k\cdot m)$$

From the heat capacity T thus obtained, the time Δt for heating LNG by one unit of temperature is determined as follows:

$$\Delta t=T/(Q/L)=5.83\cdot 10^6SEC/k$$

$$=68\ days/k$$

Thus, it takes 340 days, or about one year, to raise the temperature of LNG by 5° C.

This results from the fact that the storage tank 5005 has a concrete wall which is 16.7 m thick and which insulates heat every effectively.

When the LNG is gasified in the tank, the temperature of the LNG would not rise. Rather, the LNG will be cooled and will finally solidified.

Figure 33:
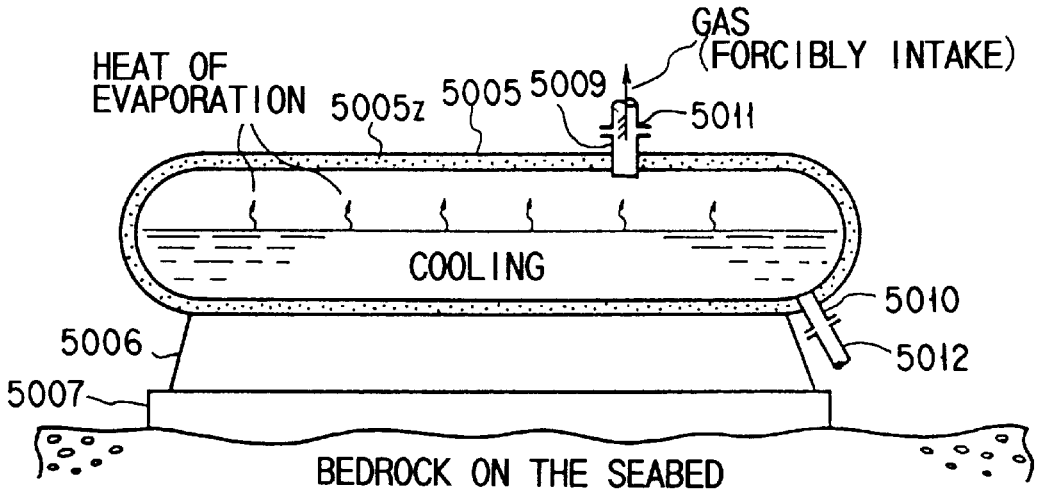
FIG. 33 is a partially sectional view explaining how LNG is drawn into the tank and cooled therein.

The suction section 5018 starts operating before the LNG temperature rises above a tolerable value, drawing the natural gas from the upper part of the tank to the LNG ground facility 5001 through the gas pipeline 5011 as is illustrated in FIG. 33.

Thus, a cooling system is constituted in the tank, which takes by itself the heat of evaporation from the surface of the LNG, thereby cooling the liquid phase of natural gas.

The amount in which the gas is drawn is controlled and the LNG is gasified, while balancing the pressure in the tank with the pressure outside the tank. Then, the submarine LNG storage system can store LNG for years by adjusting the temperature of the tank.

More specifically, the amount of LNG that should be evaporated per at least one second to prevent the temperature from rising due the heat input, by using the latent heat of evaporation (510 KJ/Kg), is (Q/L)/510=7.5 g/(m·SEC). Since the storage tank 5005 is 426.64 m long, the natural gas can be completely cooled to remain in liquid phase without using extra energy if about 3.2 Kg of methane is gasified each second.

The storage tank 5005 can store 3.3 million cubic meters of methane, or 2.38 million tons of methane. The methane in the tank is therefore constantly consumed over a considerably long time.

The autonomous LGN cooling of LGN in the tank serves to satisfy the cooling conditions which have been hardly attained.

Needless to say, the autonomous cooling carried out in the tank is achieved, thanks to the increased pressure-resistance which the tank has acquired because it is installed on the seabed.

The circulation section 5019 supplies a part of the high-pressure gas generated in the LNG ground facility 5001, into the storage tank 5005 via the gas pipeline 5011 and circulates the high-pressure gas in the storage tank 5005, as is illustrated in FIG. 34. Therefore, the LNG will be supplied under pressure from the tank to the ground facility through the liquid pipeline if the space in the upper part of the tank is pressurized, increasing the pressure on the surface of the LNG contained in the tank.

Though not incorporating pumps which are liable to malfunction, the tank has a pump system that pumps LNG autonomously. The conditions for pumping LNG are satisfied.

Controlling the amount in which the gas is circulated in the tank can of course change the rate of pumping LNG. The LNG is thus supplied under pressure, because the tank is installed on the seabed and has a high pressure-resistance.

The submarine LNG storage system can satisfy various conditions, including location condition, economical condition, cooling condition and pumping condition. It can store LNG in great quantities for a long period of time at a site near a city.

The liquid pipeline 5012 has a multi-layered structure, including an air layer, a concrete layer, which insulates the sea water temperature and the atmospheric temperature. Therefore, the sea water or the airs, ambient to the pipeline 5012, are prevented from being cooled.

In the embodiment, LNG is supplied from the LNG station built on the ground into, and thereby stored, in the storage tank installed in the deep sea. Instead, the LNG station may be built on the sea, from which LNG may be supplied into the storage tank installed on the seabed.

The storage system of this type may be applied to a deep-sea power storage system or a submarine petroleum storage system.

The preferable embodiment has a storage tank of a certain size. Nonetheless, any other tank of a different size and shape can be used as the storage tank.

As described above in detail, the present invention can provide a submarine LNG storage system which satisfies various conditions, such as location condition, economical condition, cooling condition and pumping condition. The system can therefore store LNG in great quantities for a long time at a site near a city.

Embodiment 6

A method of building a submerged tunnel, which is an embodiment of the invention, will be described with reference to FIGS. 38 to 44.

Figure 38:
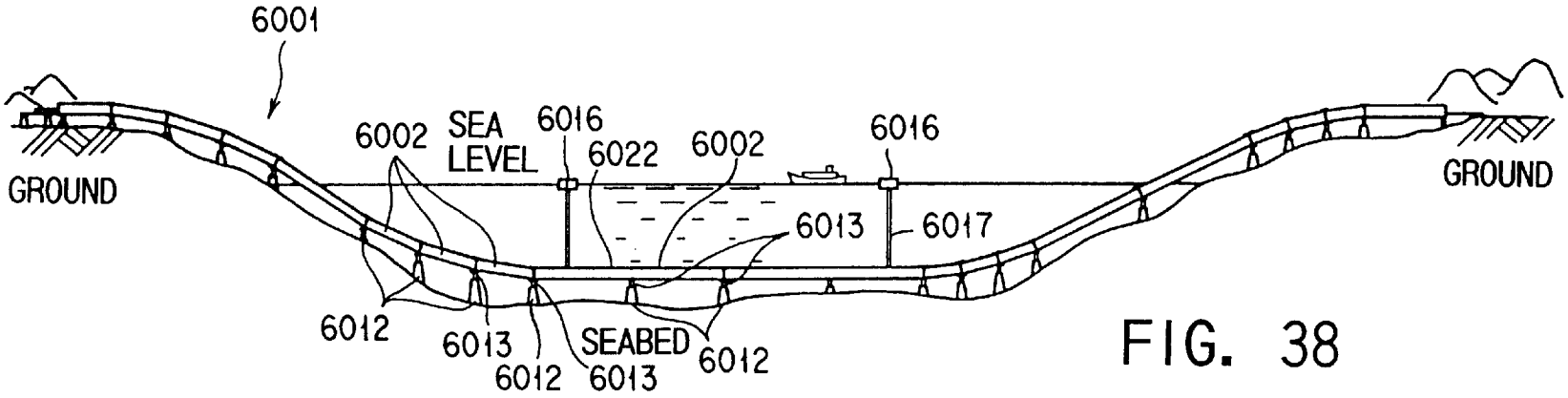
FIG. 38 is a diagram illustrating a submerged tunnel according to one embodiment of the invention, which has been built by submerged tunnel technique.

In FIG. 38, numeral 6001 denotes a large-scale submerged tunnel (submarine tunnel) which connects two geographic points and which serves as passages for roads and railways.

The submerged tunnel 6001 is composed of a number of long and huge blocks 6002 connected end to end.

To build the submerged tunnel 6001, a method of building a submerged tunnel, according to the present invention, is applied.

Figure 39:
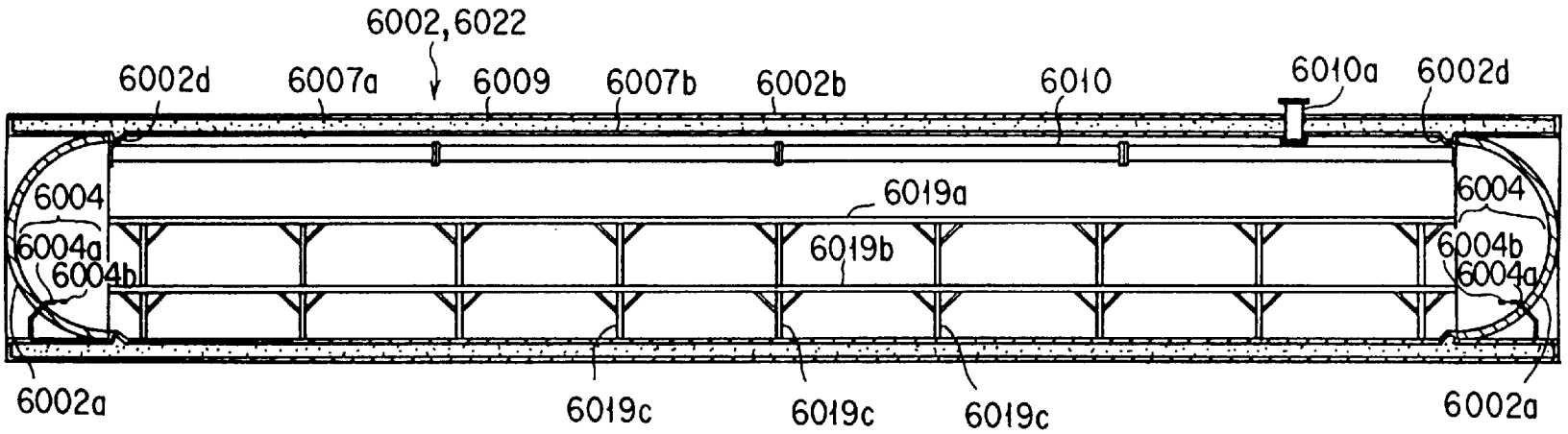
FIG. 39 is a longitudinal sectional view of one of hollow cylindrical tunnel blocks which constitute the tunnel according to the embodiment.

The method of building a submerged tunnel will be described. The method begins with manufacturing long, gigantic tunnel blocks 6002 on the sea. As shown in FIG. 39, each tunnel block 6002 is a hollow cylinder which excels in pressure resistance and which is closed at both ends with spherical covers 6002*a*. The tunnel blocks 6002 are, for example, 300 m to 500 m long, each having an outer diameter of 20 m.

Figure 40:
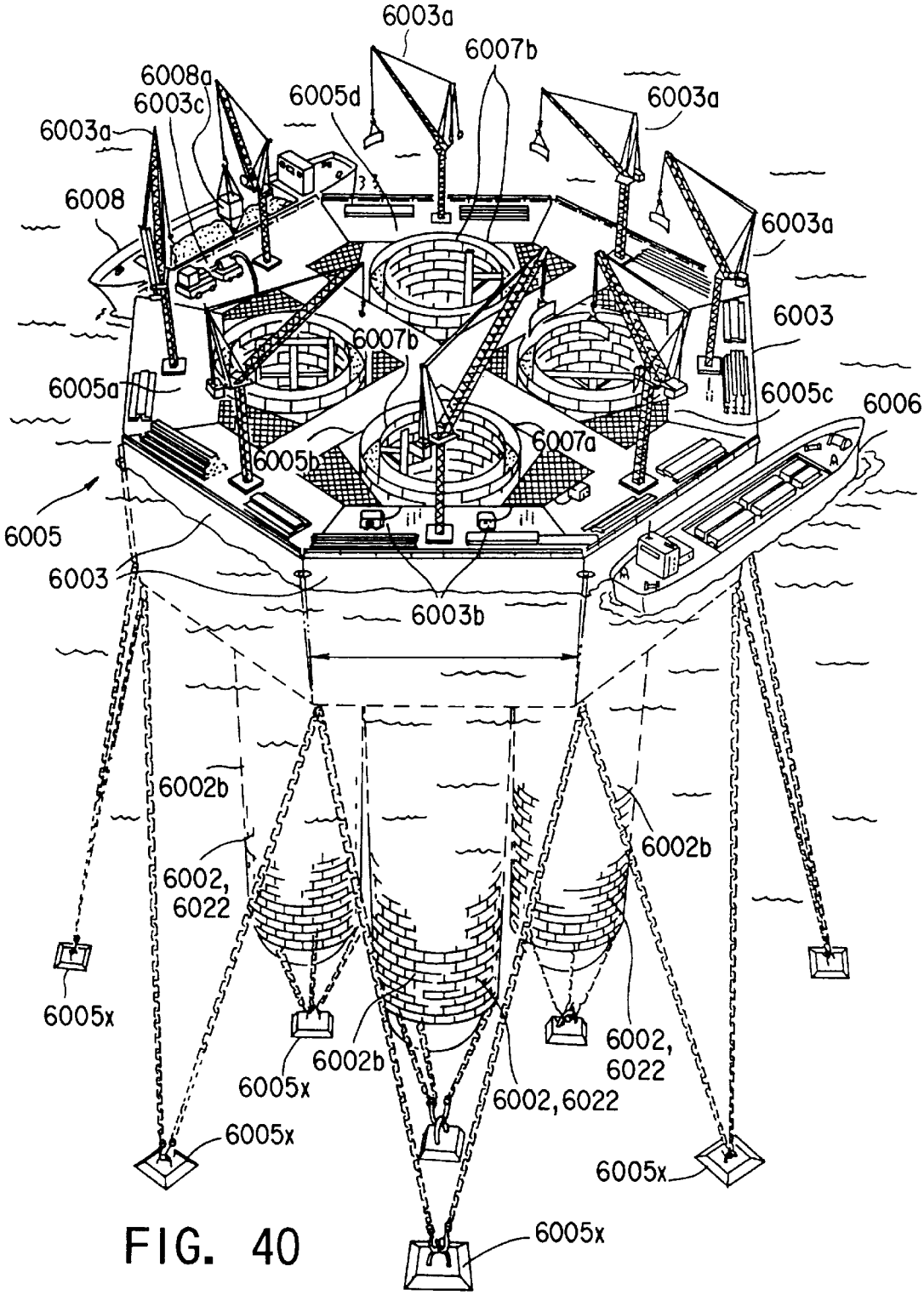
FIG. 40 is a perspective view for explaining the method of assembling tunnel blocks at a floating station on the sea, each block half submerged in the sea.

To manufacture the tunnel blocks, a floating base 6005 is constructed as shown in FIG. 40. The floating base 6005 comprises work stations 6005*a* to 6005*d* connected together, each having a polygonal through hole. The stations are blocks 6003 floating in a marine region which have a relatively large depth.

The hollow cylindrical tunnel blocks 6002 are simultaneously prefabricated in the workstations, each positioned vertically and floating on the sea. Numeral 6005*x* designates anchors which hold the floating blocks in place.

To be more specific, the tunnel blocks 6002 are manufactured in the following manner.

First, the spherical covers 6002*a* (not shown) of the tunnel blocks are made in the workstations 6005*a* to 6005*d*, respectively. Each sphercial cover 6002*a* is positioned with its opening turned upwards.

As shown in FIG. 39, each cover 6002*a* has a water supply/discharge unit 6004 which comprises a supply/discharge pipe 6004*a* and a valve 6004*d*. The pipe 6004*a* extends through the cover 6002*a*. The valve 6004*d* is provided on that part of the pipe 6004*a* which is located inside the cover 6004*a*.

Then, a transport ship laden with various materials is moored at the floating base 6005. As shown in FIG. 40, an outer cylindrical shell 6007*a* and an inner cylindrical shell 6007*b* are constructed on each spherical cover 6002*a*, in each floating block 6003. Each cylindrical shell is made by welding a number of steel plates and by operating a crane 6003*a*, a welder 6003*b* and the like provided on the floating block 6003. Both cylindrical shells 6007*a* and 6007*b* are built until they have a predetermined height. Needless to say, the junction between each cylindrical shell and the cover 6002*a* is rendered watertight.

Next, high-strength is deposited into the gap between the outer shell 6007*a* and the inner shell 6007*b*, which form a double wall hollow cylinder. The concrete is applied from a concrete batcher boat 6008 through, for example, a hopper 6008*a*. Alternatively, the high-strength concrete is deposited by driving a pump vehicle 6003C mounted on the floating block 6003.

As shown in FIG. 39, a road foundation 6019*a* and a railway foundation 6019*b* are built in each hollow cylindrical section 6002*b*. The road foundation 6019*a* and the railway foundation 6019*b* may be built after the submerged tunnel is completed. Numerals 6019*c* designate pillars supporting the road foundation 6019*a* and the railway foundation 6019*b*.

The welding of steel plates and the deposition of concrete are performed in the order mentioned. The hollow cylindrical section, including the road foundation 6019*a* and the railway foundation 6019*b*, is thereby constructed, gradually lengthening in vertical direction (upwards). One end of the hollow cylindrical section 6002*a* is constructed, surrounding the cover 6002*a*.

In the process of building the hollow cylindrical section 6002*b*, the buoyancy of the section 6002*b* is adjusted. The tank is thereby lowered into the sea in a standing position, with the spherical cover 6002*a* at the lowest position and the open end remaining at the level of the floating base 6005.

That is, when the hollow cylindrical section 6002*b* grows to a certain height, fluid, e.g. sea water, is poured into the section 6002*b* by means of the water supply/discharge unit 6004. The buoyancy of the structure being built is thereby adjusted so that the top of the section 6002*b*, where the work is progressing, remains at an appropriate level (the same level).

The sequence of work steps, described above, is repeated, thereby building the hollow cylindrical section 6002*b* that has the desired length and outer diameter.

While the hollow cylindrical section 6002*b* is being built, a ventilating duct 6010 is provided in the section 6002*b* to apply air into the section 6002*b*. The ventilating duct 6010 extends in the axial direction of the section 6002*b*. Also provided in the hollow cylindrical section 6002*b* is a duct connector 6010*a*. The connector 6010*a* is connected at one end to the ventilating duct 6010. It opens at the other end to the exterior of the hollow cylindrical section 6002*b*. The open end of the duct connector 6010*a* is closed by, for example, a removable cover (not shown).

The other spherical cover 6002*a* is fastened to the upper end of the hollow cylindrical section 6002*b*. More precisely, the cover 6002*a* is set in tight contact with the annular seat 6002*d* provided in the upper end of the section 6002*b* and secured thereto, as is illustrated in FIG. 39. Needless to say, a water supply/discharge unit 6004 is provided in this spherical cover 6002*a*, too. The junction between the cover 6002*a* and the upper end of the section 6002*b* is rendered watertight.

The hollow cylindrical tunnel blocks excelling in heat resistance are thereby built at the workstations 6005*a* to 6005*d*, respectively. A ballast tank (not shown) is provided in each tunnel block 6002 thus completed.

The long, huge cylindrical tunnel blocks 6002 are towed to an installation site (tunnel laying site), where they are submerged onto the seabed to become a part of a submerged tunnel 6001.

Figure 41:
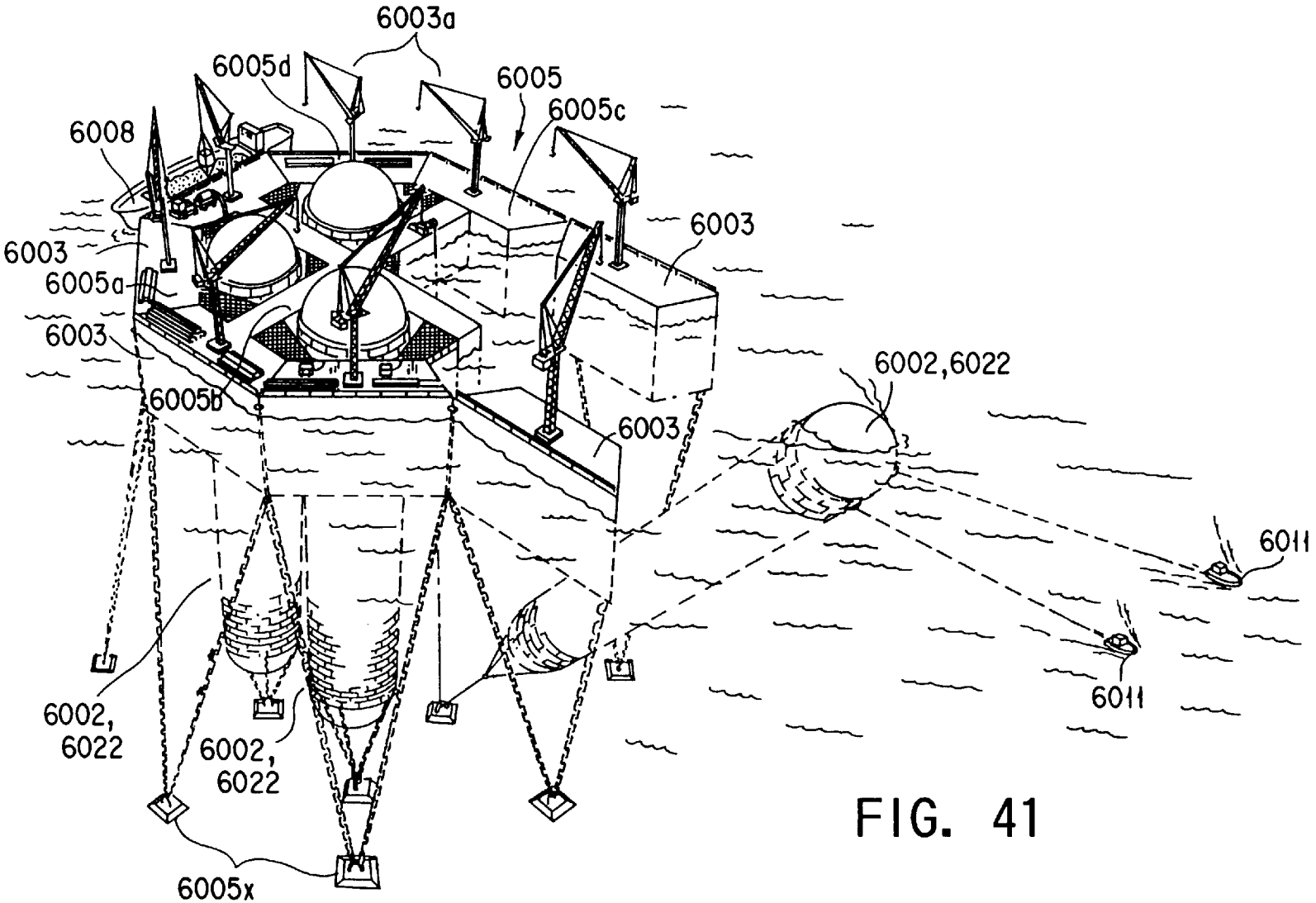
FIG. 41 is a perspective view for explaining how each tunnel block assembled is towed from the floating station to a designated site.

To be more specific, some sections of the floating block 6003, in which the tunnel block 6002 has been built, are moved as shown in FIG. 41 so that the tunnel block 6003 may be towed from the floating base 6005.

Seawater is then discharged from the tunnel block 6002 by the supply/discharge unit 6004. At the same time, water is poured into the ballast tank provided in the tunnel block 6002, adjusting the buoyancy thereof. The tunnel block 6002 is thereby tilted from a vertical position to a horizontal position, while it is floating on the sea.

Tugboats 6011 tow the tunnel block 6002 thus tilted, to a site where seabed foundations 6012 have been constructed, arranged at predetermined intervals.

At the site on the sea, a seal 6018 (seal member) made of, for example, cushioning material is placed on the entire end of the hollow cylindrical section 6002*b* of the tunnel block 6002.

Further, a connecting hollow cylinder 6015 (seal member) is mounted on the end portion of the hollow cylindrical section 6002*b*. The cylinder 6015 has its free end portion extending from the end of the section 6002*b*. The cylinder 6015 is sealed at its end which is mounted on the section 6002*b*.

The tunnel block 6002 may be one which has a duct connector 6010*a*. If so, the duct connector 6010*a* is connected to a flexible ventilating duct 6017 that in turn is connected to a ventilation buoy 6016.

Figure 44:
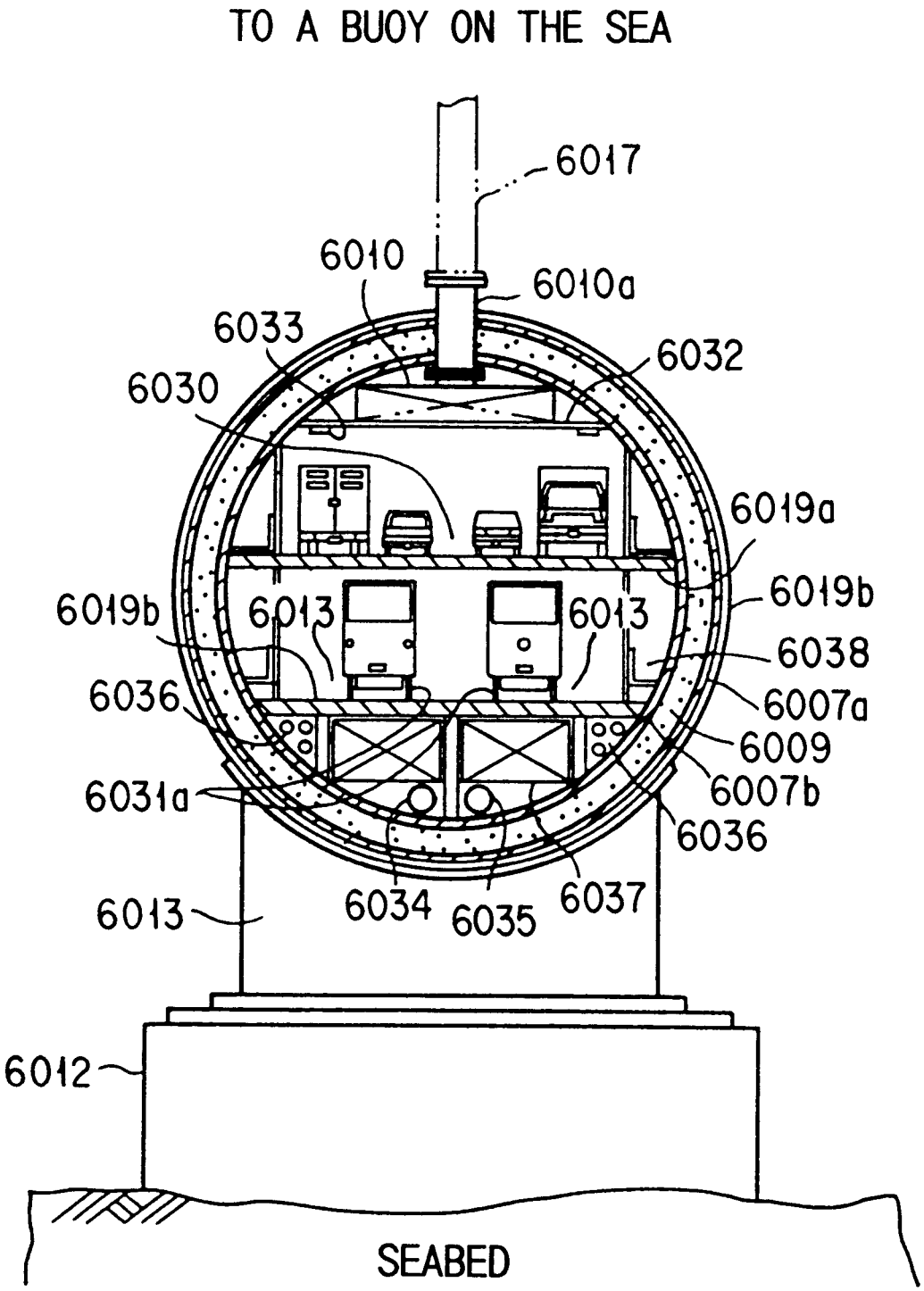
FIG. 44 is a sectional view illustrating the interior of the completed tunnel.
Figure 45:
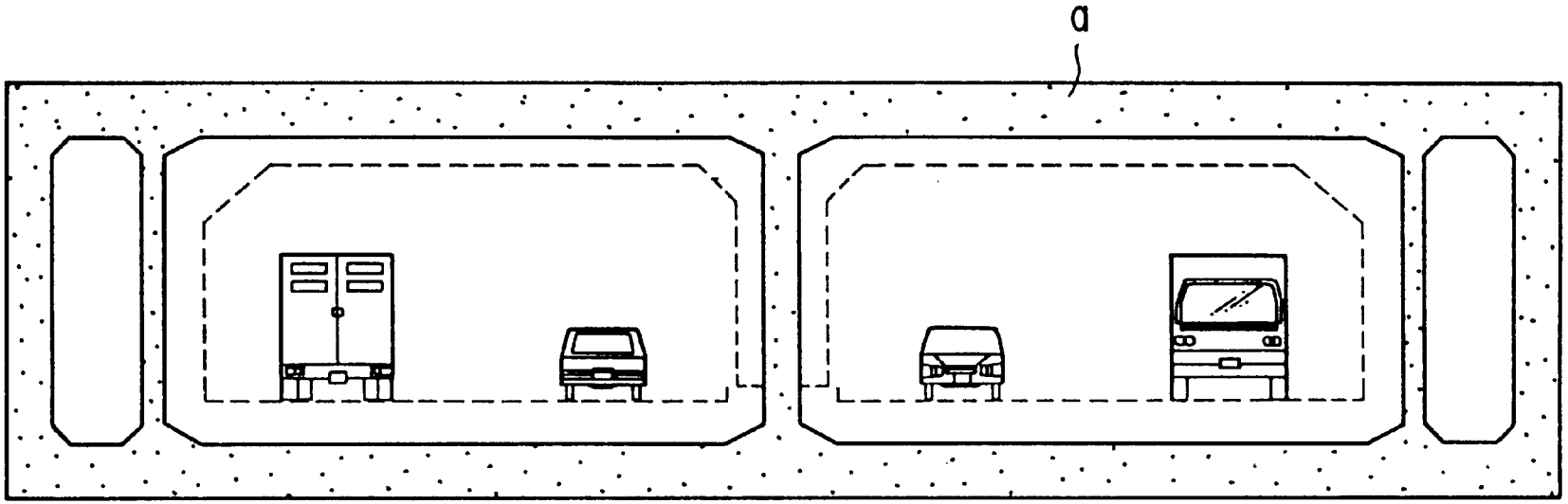
FIG. 45 is a sectional view of a conventional tunnel block manufactured on the ground.

Thereafter, water is poured into the ballast tank (not shown) provided in the tunnel block 6002. The tunnel block 6002 is thereby set on two tunnel trestles 6013 mounted on the seabed foundations 6012, as is illustrated in FIG. 44. The tunnel trestles 6013 support the tunnel block 6002 at its lower circumferential surface.

The tunnel block 6002 is then welded to the tunnel trestles 6013 and fastened thereto with wire ropes (not shown). The block 6002 is thereby secured to the tunnel trestles 6013. The seabed foundations 6012 are secured to the seabed with stakes (not shown).

Thus, the first tunnel block 6002 is installed at the seabed.

Next, the tunnel block 6022 to be connected to the tunnel block 6002, having no connecting hollow cylinder 6015 attached to it, is towed from the floating base 6005. The tunnel block 6022 is then set on two tunnel trestles 6013 in the same way as the first tunnel block 6002.

Figure 42:
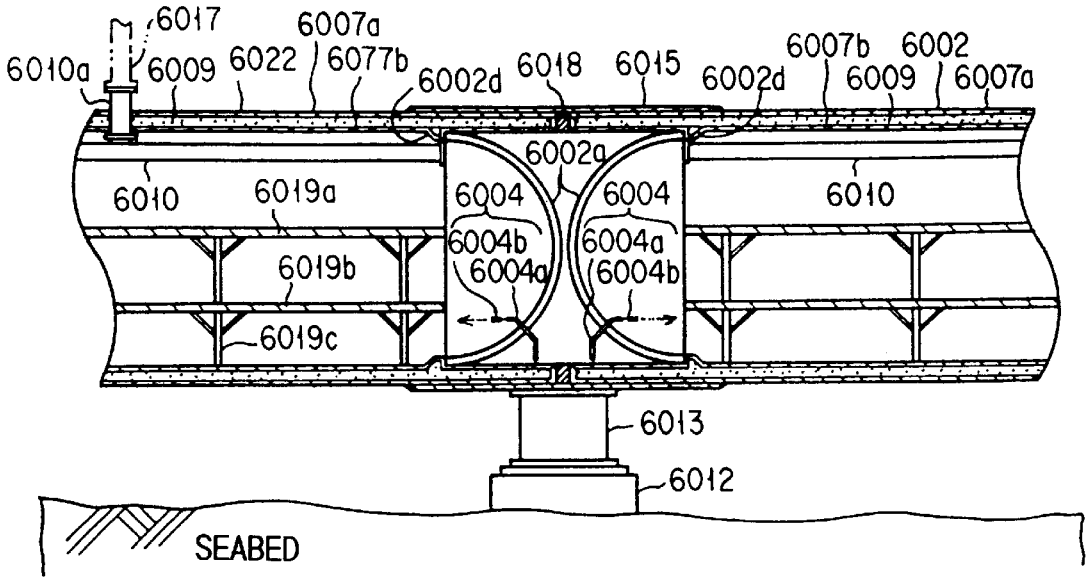
FIG. 42 is a sectional view explaining how two tunnel blocks are positioned, with their opposing ends on a base built on the seabed and how they are connected, end to end.
Figure 43:
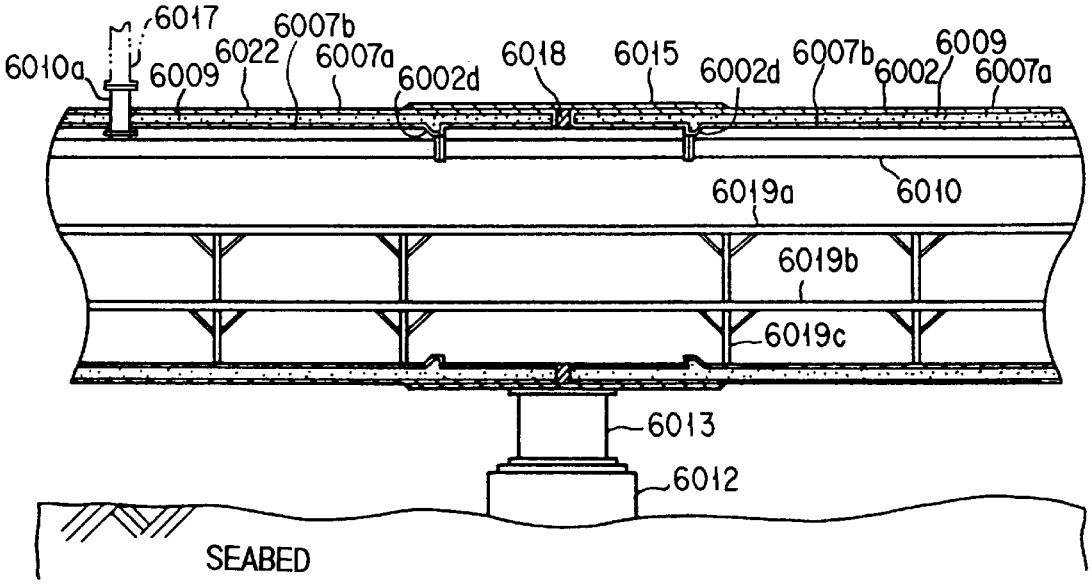
FIG. 43 is a sectional view explaining how the two tunnel blocks are connected in their interior.

As shown in FIG. 42, one end of the tunnel block 6022 is inserted into the connecting hollow cylinder 6015 until it abuts on the end of the tunnel block 6002. The abutting ends of the tunnel blocks 6002 and 6022 are sealed together, with the seal 6018 overlapping the end of the tunnel block 6002.

Then, the tunnel block 6022 is secured and sealed to the connecting hollow cylinder 6015. The adjacent two tunnel blocks 6002 and 6022 are thereby coupled to each other.

The junction between these tunnel blocks is a double-wall structure comprising the spherical shell (i.e. inner wall) and a hollow cylinder (i.e. outer wall). Hence, sea water would not leak into the junction in the process of coupling the tunnel blocks.

Next, the tunnel blocks 6002 and 6022 are made to communicate with each other, as will be explained below.

At first, the supply/discharge unit 6004 draws sea water from the closed space between the spherical shell sections, or the spherical covers 6002*a* and 6022*a*. That is, sea water is discharged from the junction between the two tunnel blocks.

As a result, an external pressure, i.e., sea water pressure, is applied on the seal 6018. The seal 6018 is thereby set, sealing the junction between the tunnel blocks.

Underwater concrete (not shown) is injected into the seal 6018, thereby stiffening the seal 6018.

The junction between the tunnel blocks is first sealed with the connecting hollow cylinder 6005 and is further sealed with the seal 6018 (each time by the use of a seal material). Leakage of sea water into the tunnel blocks 6002 and 6022 is thereby prevented.

Now that the leakage of sea water is prevented, the spherical shell sections, or the covers 6002*a* and 6022*a*, are removed. The interiors of the tunnel blocks 6002 and 6022 are thereby connected to each other.

The sequence of steps, described above, is repeated on the route for the submerged tunnel, including the coast and the land. Other tunnel blocks 6002 (6022) of the same structure are thereby laid in series on the seabed. As a result, a submerged tunnel 6001 is built, extending along the route, from one coastal site to another.

The road foundations 6019*a*, railway foundations 6019*b* and ventilation ducts 6010 are connected. Then, in the tunnel thus built, rails 6031*a* are laid on the road foundations

6019*b*, forming a roadbed (not shown), as is illustrated in FIG. 44. A road 6030 is thereby constructed. Further, railways 6031 are constructed on the railway foundations 6019*a*. Still further, duct holders 6032, lights 6033, water pipes 6934, drain pipes 6035, various kinds of cables 6036 (optical fiber cables, power supply cables, and the like), escape passages 6038, and the like are provided in the tunnel. A large-scale submerged tunnel incorporating roads and railways is thus constructed.

As described above, the tunnel blocks 6002 (6022) are built on the sea, using the buoyancy acting on each tunnel block, in the method of building the submerged tunnel 6001. That is, a large space available on the sea is utilized to manufacture the tunnel blocks 6002 (6022).

Tunnel blocks which excel in pressure resistance and which are too long and large to be manufactured on land can be built on the sea. For example, tunnel blocks 6002 (6022) which are 300 to 500 m long, having an outer diameter of 20 m, can be manufactured.

The method of the invention can therefore build a large-scale submerged tunnel 6001 which incorporates roads and railways.

In the method, hollow cylindrical tunnel blocks are built, while being partly submerged in the sea in a standing position. Hence, the site of manufacturing them is relatively compact and small. This helps to enhance the manufacturing efficiency.

Built while being partly submerged in the sea in a standing position, the tunnel blocks 6002 (6022) can be manufactured at low cost and a small number of man-hours.

Namely, it suffices to deposit a small amount of concrete into the horizontal parts of each tunnel block 6002 (6022), because the tunnel block is gradually submerged into the sea as it is manufactured. Further, since the concrete section of the block, that is submerged in the sea, receives a compressing stress from the sea water, it is unnecessary to use reinforcing members which must be used to deposit concrete to build a tunnel block on the ground.

Furthermore, the tunnel blocks 6002 (6022) not only excel in pressure-resistance and outer appearance, but also are simple in structure, not using reinforcing bars. This is because the blocks remain compressed while being manufactured. They are of, for example, steel-concrete structure, each composed of only steel plates and high-strength concrete as described above.

Hence, it can be expected that a large-scale submerged tunnel be built at low cost and within a short time, though the tunnel blocks 6002 (6022) are long and huge ones.

Moreover, the construction of the tunnel can be started at any point in the planned route or at two or more points at the same time, because the tunnel blocks 6002 (6022) can be manufactured simultaneously on the sea as mentioned above. This helps shorten the time required for building the submerged tunnel.

As indicated above, the flexible ventilating duct 6017 connected to the duct connector 6010*a* provided on each tunnel block 6002 is connected to the ventilation buoy 6016 floating on the sea. Therefore, the submerged tunnel can be ventilated, however long it is, without accomplishing a large-scale civil engineering work, such as building of artificial islands.

In the present embodiment, the driveways are built on the upper floor, and the railways on the lower floor. Nonetheless, the invention is not limited to this structure. Rather, the present invention can be applied to submerged tunnels of any other structures.

As described above in detail, the present invention uses a vast space available on the sea to manufacture tunnel blocks. The invention makes it possible to manufacture tunnel blocks that are too long and huge to be manufactured on land. For instance, tunnel blocks having a length of 300 to 500 m and an outer diameter of 20 m can be manufactured according to the present invention.

Furthermore, the site of manufacturing hollow cylindrical tunnel blocks is compact and small since the blocks are built, while being partly submerged in the sea in a standing position. This helps to enhance the manufacturing efficiency, to lower the manufacturing cost, and to decrease the number of man-hours required.

Therefore, a large-scale submerged tunnel can be built by using long and gigantic concrete tunnel blocks, which have been manufactured at low cost within a short time.

In addition, the construction of the tunnel can be started at any point in the planned route or at two or more points at the same time. This is because the tunnel blocks can be manufactured simultaneously on the sea. As a result, the time required for building the submerged tunnel can be shortened.

Industrial Applicability

As has been described above, the method of manufacturing a large tank, according to the present invention, is desirable in manufacturing huge tanks which may be used to build a submerged tunnel and which may be used as a $CO_2$ storage tank, a submarine living quarter, a submarine station, a battery tank and the like.

What is claimed is:

1. A method of manufacturing a large tank comprising the steps of:

constructing a floating base on the sea around a first spherical shell section constituting one end of a tank;

building a hollow cylindrical section on the spherical shell section, in the floating base;

attaching a first open end of the cylindrical section to the first spherical shell section; and attaching a second spherical shell section to a second open end of the hollow cylindrical section to close the second open end thereof.

* * * * *